US009266649B1

(12) United States Patent
Mar

(10) Patent No.: US 9,266,649 B1
(45) Date of Patent: Feb. 23, 2016

(54) SAFETY CONTAINER PROVIDING OPTIONAL OPENING AND CLOSING ARRANGEMENTS

(71) Applicant: Bob Mar, Fresno, CA (US)

(72) Inventor: Bob Mar, Fresno, CA (US)

( * ) Notice: Subject to any disclaimer, the term of this patent is extended or adjusted under 35 U.S.C. 154(b) by 0 days.

(21) Appl. No.: 14/830,113

(22) Filed: Aug. 19, 2015

Related U.S. Application Data

(63) Continuation of application No. 14/454,679, filed on Aug. 7, 2014, now Pat. No. 9,120,605.

(51) Int. Cl.

| | |
|---|---|
| ***B65D 43/22*** | (2006.01) |
| ***B65D 43/16*** | (2006.01) |
| ***B65D 50/06*** | (2006.01) |

(52) U.S. Cl.
CPC ..... *B65D 43/22* (2013.01); *B65D 43/16* (2013.01); *B65D 50/06* (2013.01); *B65D 2215/04* (2013.01); *B65D 2543/0099* (2013.01)

(58) Field of Classification Search
CPC ..... B65D 45/22; B65D 45/24; B65D 45/20; B65D 45/16; B65D 43/022; B65D 43/0214; B65D 50/067; B65D 50/069; B65D 50/06; B65D 55/10; B65D 55/02; B65D 43/16; B65D 43/22; B65D 50/04
USPC ..... 220/326, 324, 315, 830, 827, 810, 811, 220/812, 789, 780, 801, 796; 215/213, 211, 215/201; 292/283, 256.5, 256
See application file for complete search history.

(56) References Cited

U.S. PATENT DOCUMENTS

| | | | |
|---|---|---|---|
| 3,240,039 | A | 3/1966 | Baerman |
| 3,576,238 | A | 4/1971 | Chubb |
| 3,642,161 | A | 2/1972 | Stroud |
| 3,860,135 | A | 1/1975 | Yung et al. |
| 3,924,768 | A | 12/1975 | Lemons |

(Continued)

FOREIGN PATENT DOCUMENTS

| | | | |
|---|---|---|---|
| CN | 1735540 | B | 6/2010 |
| EP | 609955 | A1 | 8/1994 |

(Continued)

OTHER PUBLICATIONS

Bandoh, T. et al., Covered container, English Abstract of Chinese Patent Publication CN1735540, Jun. 16, 2010, European Patent Organization, http://www.epo.org/searching/free/espacenet.html.

(Continued)

*Primary Examiner* — Robert J Hicks
(74) *Attorney, Agent, or Firm* — Mark D. Miller; William K. Nelson

(57) ABSTRACT

The present invention includes a lockable safety container that incorporates a pop-up lid to enable person having disabilities to open the safety container, while the safety container retains childproofing features. The childproofing features include a locking pin, a locking tab, and a slide detent. The locking pin is internally biased by a spring that urges the pin to slide in a slideway in the lid of the container. The locking pin may be locked into a closed position by positioning the locking tab into a lock-out position. In the lock-out position, the locking tab cannot slide within a mating slot in the lid and thus the locking pin cannot slide in the slideway in the lid. The childproofing features of the safety container may require the user to engage in at two least distinct hand motions in order to open the container.

45 Claims, 12 Drawing Sheets

(56) References Cited

U.S. PATENT DOCUMENTS

| | | | |
|---|---|---|---|
| 3,987,876 | A | 10/1976 | Foults |
| 4,094,392 | A | 6/1978 | Gregg et al. |
| 4,146,146 | A | 3/1979 | Mar |
| 4,257,537 | A | 3/1981 | Uhlig |
| 4,358,022 | A | 11/1982 | Geiger |
| 4,458,819 | A | 7/1984 | Geiger |
| 4,509,622 | A | 4/1985 | Morszeck |
| 4,535,903 | A | 8/1985 | Franchi |
| 4,576,307 | A | 3/1986 | Frydenberg |
| 4,774,973 | A | 10/1988 | Gueret |
| 4,852,770 | A | 8/1989 | Sledge et al. |
| 4,984,698 | A | 1/1991 | Stuckey |
| 5,000,339 | A | 3/1991 | Wheat et al. |
| 5,040,691 | A | 8/1991 | Hayes et al. |
| 5,193,707 | A | 3/1993 | Mizumura |
| 5,346,069 | A | 9/1994 | Intini |
| 5,370,081 | A | 12/1994 | Gordon |
| 5,394,966 | A | 3/1995 | Chow |
| 5,460,288 | A | 10/1995 | Balzeau |
| 5,682,910 | A | 11/1997 | Kizawa et al. |
| 5,752,612 | A | 5/1998 | Fritzsche et al. |
| 5,887,736 | A | 3/1999 | Mar |
| 5,908,131 | A | 6/1999 | Yamaguchi |
| 6,059,135 | A | 5/2000 | James et al. |
| 6,095,364 | A | 8/2000 | Dickie et al. |
| 6,367,639 | B1 | 4/2002 | Mar |
| 6,409,034 | B2 | 6/2002 | Schorner |
| 6,824,006 | B2 | 11/2004 | Lambelet, Jr. |
| 7,311,205 | B2 | 12/2007 | Adler et al. |
| 7,370,773 | B2 | 5/2008 | Toth et al. |
| 7,621,420 | B2 | 11/2009 | Bandoh et al. |
| RE41,323 | E | 5/2010 | Kellerer et al. |
| 7,837,051 | B2 | 11/2010 | Broadhead et al. |
| 7,946,447 | B2 | 5/2011 | Toth et al. |
| 8,016,147 | B2 | 9/2011 | Broadhead et al. |
| 8,167,858 | B2 | 5/2012 | Radford et al. |
| 8,276,777 | B2 | 10/2012 | Shieh et al. |
| 8,657,136 | B2 | 2/2014 | Adler et al. |
| 2012/0111821 | A1 | 5/2012 | Starr et al. |

FOREIGN PATENT DOCUMENTS

| | | | |
|---|---|---|---|
| WO | 2004063041 | A1 | 7/2004 |
| WO | 2007082363 | A1 | 7/2007 |
| WO | 2011117769 | A1 | 9/2011 |

OTHER PUBLICATIONS

Bandoh, T. et al., Covered container, English Abstract of WIPO Patent Publication WO2004063041, Jul. 29, 2004, European Patent Organization, http://www.epo.org/searching/free/espacenet.html.

Manker, Edgar, Child-Proof Closure Device, English Abstract of WIPO Patent Publication WO2007082363, Jul. 26, 2007, European Patent Organization, http://www.epo.org/searching/free/espacenet.html.

Section A-A

DETAIL C

DETAIL C

SAFETY CONTAINER PROVIDING OPTIONAL OPENING AND CLOSING ARRANGEMENTS

This application is a continuation application of U.S. application Ser. No. 14/454,679, filed on Aug. 7, 2014, which is pending and is incorporated herein by this reference in its entirety.

FIELD OF THE INVENTION

The present invention relates to safety containers. More specifically, this invention relates to safety containers of the type that are intentionally designed to be difficult for children to open or to gain access to the contents of the container.

BACKGROUND

Pharmaceutical manufacturers, pharmacists, and others have long sought to provide safety containers for contents such as drugs and other potentially dangerous contents. The object of their search has been to provide a container that can be opened readily by an adult but not by a child.

One safety container that has existed for some time is the "push-and-twist" container. The push-and-twist container requires the person opening the container to push down forcefully on the cap of the container and simultaneously twist the cap to unscrew it and move it to a position where it can be lifted off of the container.

One problem with the push-and-twist type of container is that the twist cap entirely separates from the container when the container is opened. The cap can be lost, and in any event, the separate cap requires effort to locate and place the cap back onto the container body in order to close the container. In addition, when the user has multiple such containers open, as is often the case for elderly persons who often must take more than one type of drug at a time the user can mix-up the lids and place the wrong cap on the wrong container or, because of the effort required to keep track of the disparate caps and replace them on the correct container, simply leave the caps off of their containers. These types of mix-ups or a failure to close the containers defeats the very purpose of putting a safety cap or lid on the container at all.

Another problem with the push-and-twist container is that it requires only one pushing and twisting motion in order to open the container. A child need only figure out that one push-and-twist motion in order open the container.

Yet another problem with the push-and-twist container is that it has only one mode of closing and opening. Many people, however, rarely if ever have children in their homes. The conventional push-and-twist caps are also inconvenient because they require the use of two hands to open. The push-and-twist mechanism cannot, be operated easily without the use of both hands, in the absence of a tool. Persons who have difficulties using one of their hands due to a medical issue (e.g., neurological damage, broken bone(s), amputation, etc.) or who are simply weak or suffer from coordination difficulties may find it difficult and perhaps even impossible to perform the push-and-twist motion. Therefore, a safety container that is both suitable for pharmaceutical packaging and operable with one hand is desirable.

Even in the case of a healthy adult, the user may not want, or have a need to utilize any more than minimal safety features on a particular safety container. For these and other reasons, these types of users may have no need, desire, or ability to themselves repeatedly engage in the substantial push-and-twist effort required to utilize the push-and-twist container. For these types of users, the push-and-twist and similar types of safety containers do not provide an adequate solution to the problem of providing a container that will be relatively securely closed when not in use, depending on the needs of the user.

One solution to these types of problems is the hinge-lid safety container, such as that shown is U.S. Pat. No. 4,146,146, entitled "Safety Containers" ("the '146 patent"). Because the hinged lid is secured to the container by the hinge, the cap is not lost, misplaced, or difficult to position adjacent the opening of the container when closing the container.

With the device shown in the '146 patent the lid is opened by inserting, a sufficiently long fingernail into a relatively small and hidden slot in a locking pin slidably mounted in the lid, and then pulling, with the finger nail, the pin out of its force-fit engagement with the upper lip of the container in order move the pin away from the force-fit engagement and the lid to rotate into the open position. The '146 device is often easier for many seniors and others to use than the twist-and-pull container because, once the pin is pulled out and the cap is opened, the cap may be opened and relatively securely closed without resetting the pin.

Conventional safety containers are inconvenient and can be difficult to open even for adults. Thus, there is a need for improved safety containers that can be easily and reliably opened, while maintaining child-proof characteristics.

SUMMARY OF THE INVENTION

The present invention provides safety container devices and methods of using the same. More particularly, the present invention relates to safety containers that have attached lids and are operable with one hand. The invention is particularly suitable for use in packaging and storing pharmaceuticals.

The present invention may be utilized to safely contain pharmaceuticals. It also may be used to more safely contain other types of hazardous materials that may pose a risk to children and/or that need to be stored in a container having a liquid- and/or air-tight seal, such as cleaning fluids or powders. The present invention may also provide a more user-friendly safety container that is easier to open than conventional safety containers, while still maintaining childproof characteristics.

The applicant has discovered that one way to render a container less likely to be opened by children is to preferably require at least two independent finger motions (aside from a third cap removal motion), at least one of which preferably requires some dexterity. The applicant has further discovered that a safety container should offer a capable adult the option of defeating certain safety features or steps that are unnecessary for containers used in, for example, a home unoccupied and not visited by children.

The applicant has invented a safety container having a lid that is attached to the container by a hinge and multiple childproofing characteristics: (1) a locking pin, (2) a locking tab, and/or (3) a slide catch mechanism. The locking pin may be slidably mounted in the container cover or lid to move between a locking and opening position. The locking pin may be moved from a "closing position" (preventing the container from being opened) to an "opening position" by the application of force by the user, thereby allowing, the lid to open and access to the contents of the container. The locking pin may function as a deadbolt or spring-bolt lock, meaning that a locking end of the locking pin is inserted into a recess or cutout (a locking slot) in the wall of the safety container that has a complementary shape to the locking end (the "closing position") and the locking end remains in the closing position until a user of the safety container applies force to an actuation pad to displace the locking end from the locking slot. The locking end of the locking pin may have a trapezoidal shape like the male piece of a dovetail joint, in which the lateral sides (tenons) of the locking end slope outward, and the locking slot may have a complementary trapezoidal shape like the female piece of a dovetail joint with lateral portions that slope outward (mortises). The complementary shapes of the locking end and the locking slot together form form a flush-fit dovetail joint when the locking pin is in the closing position, giving the connection between the locking pin and the container wall substantial strength. Other shapes and configurations of the locking, end of the locking pin and the corresponding locking slot are contemplated within the scope of the present invention. For example, the locking end may be other shapes such as a circle, an ellipse, various superellipses, a rectangle, a rhombus, various other shapes, and the locking slot may have a complementary shape thereto.

The locking pin may also be spring-biased that causes the locking pin to automatically move toward the closing position when no extrinsic force is applied to the pin by the user. Also, the spring allows the locking pin to pop into the closing position automatically when the user pushes the lid closed over the safety container. As the user presses the lid down onto the upper rim of the container, the locking end of the locking pin is forced outward as it meets the upper rim. When the lid has been pressed down to where it meets flush with the upper rim of the safety container, the locking end of the locking pin aligns with the complementary locking slot in the upper rim, and the stretched spring, draws the locking end into the locking slot, thereby locking the lid in place over the container (similar to a spring-bolt lock). Thus, the spring may allow the lid to be securely closed over the container by a single closing motion of the user's hand pushing the lid toward the container body. In some embodiments, and without limitation, the locking pin may include an S-shaped spring, molded integrally as a part of the locking pin for biasing the locking, pin toward the locked position. The spring may have an end that engages with a stationary portion of the container lid as an anchor point from which the spring may be stretched in order to bias the locking pin toward the locking position.

The locking tab may also be attached to the lid and may have a "lock-out position" which may arrest the locking pin and thereby prevent it from being moved into the "opening position," and an "unlocked position" allowing the locking pin to be moved into the opening position. The lid may have a locking tab, a tab slot, and a locking tab notch, and the locking tab may be moveable between (i) the unlocked position in which the locking tab can move or slide into the slot to allow the pin to move with respect to the lid, and (ii) the lock-out position in which the tab is engaged with the locking tab notch and cannot penetrate the slot or allow motion of the locking pin with respect to the lid. The locking tab may be rotatable in a plane parallel to and above the slide plane of the locking pin. There may be a catch or protuberance between the tab slot and the locking notch that prevents the locking tab from being moved into the locked position without the application of pressure. In some embodiments, the locking tab may be resilient, and may flex when it contacts the catch or protuberance as it moves between its unlocked and lock-out positions.

The slide catch mechanism may include a detent or catch positioned inside a slideway (pin channel) in the container lid. The container lid has a slideway that runs through the central portion of the lid. The locking pin is positioned within the slideway and moves through the slideway when a user applies force to the actuation pad. The detent may contact a protrusion on the upper portion of the locking pin within the slideway. When the detent contacts the protrusion on the locking pin, the locking pin is prevented from advancing to the open position. In order to overcome the slide catch mechanism, the user may apply downward force on the actuation pad as the user advances the locking pin through the slideway toward the open position. The downward force may move the protrusion on the locking pin to a position that is inferior to the detent, thereby allowing the locking pin to move past the detent. Thus, the slide catch mechanism may prevent a child from advancing the locking pin into the open position because it may not be readily apparent that the application of downward pressure on an actuation pad may be required to advance the locking pin.

The safety container of the present invention may also include features that assist a user to quickly open the container once the childproofing characteristics are overcome. For example, and without limitation, the safety container may include features that allow a person to easily open the container with one hand. The safety container may also include features that allow the user to open the container by feel or touch.

For example, and without limitation, the safety container of the present invention may include a mechanism which biases the lid toward opening when the locking pin is moved into the opening position. For example, and without limitation, the lid may have a raised middle section that creates an upside down U-like shape or convexity in the lid. To close the lid, the middle section may be compressed inward toward the interior of the container to flatten out the lid so that it can, meet the upper rim of the container. In this example, the raised middle section of the lid may be pressed down and compressed and deformed in order to place the lid in a closed position to where the locking pin engages with the complementary slot in the container wall. The compressed middle section of the lid may store potential energy in the lid due to the deformation of the lid when the lid is in the closed position, and the lid may exert a downward force against the container such that the lid is biased or urged toward opening when the locking pin is moved into the opening position. Upon moving the locking pin into the opening position, the compressed middle section may push downward on the container, thereby pushing the lid away from the container body and allowing the lid to pop open. The biased lid may allow the safety container to be more easily used especially by a person who may have difficulties using one of their hands due to a medical issue.

Without limiting the invention, the safety container may also include an actuation pad that protrudes from the container lid when the locking pin is in the starting position to provide a tactile reference point to allow a user to find the actuation pad by touch without the need to visually inspect the safety container. In other implementations, and without limitation, the actuation pad may be recessed from an outer edge of the container lid to thereby provide a tactile reference point and limit access to the actuation pad, making it difficult for a child to operate the actuation pad due to the typical lack of dexterity in small children.

The above described features are some of the novel features of the safety containers described herein. There are additional features that address safety and other functionalities that are described in the following general description of the embodiments of the present invention.

Embodiments of the present invention may be drawn to safety containers that may include a container body having a locking slot in an upper rim of the body; a container lid having a convex structure such that the container lid must be compressed into the upper rim of the container body in order to conform to the upper rim; a locking pin slidably mounted within a pin channel (or slideway) in the container lid and adapted to move between (i) a locked position lockingly engaging a locking slot, and (ii) an open position in which the locking pin is disengaged from the locking slot; a locking tab slot within the container lid; and a locking tab rotatably mounted in the container lid moveable to rotate between (i) an opening position in which the locking tab may penetrate the locking tab slot and allow relative movement between the container lid and the locking pin, and (ii) a lock-out position in which the locking tab is positioned within a locking tab notch and may not penetrate the locking tab slot, thereby preventing relative movement between the container lid and locking pin. The container lid may be rotatably mounted on the container body on an attached side of the container lid opposite a locking side of the container lid, at which the locking end of the locking pin may be positioned and lockingly engage the locking slot.

In such embodiments, and without limitation, the locking pin may include an actuation pad that can be pushed to advance the locking pin in the pin channel (or slideway), and the container lid may have abutment for blocking the actuation pad from advancement past the abutment. This feature allows the locking pin to be advanced far enough through the pin channel to be disengaged from the upper rim of the container to allow the lid to be opened and expose the interior of the container. The locking pin may be made of a resilient material and may include a spring integrally formed in the locking pin with a proximal section adapted to engage at one end with the abutment or some other anchoring structure in order to anchor the spring and allow it to be stretched from the abutment as the locking pin advances in the pin channel, whereby the spring and the abutment cooperatively bias the locking pin to slide into the closing position. Thus, the resilience of the spring allows the locking pin to return to a starting position in which tension in the spring is released when the user releases the actuation pad. In some implementations, and without limitation, the actuation pad may protrude from the container lid when the locking pin is in the starting position to provide a tactile reference point to allow a user to find the actuation pad by touch without the need to visually inspect the safety container. In other implementations, and without limitation, the actuation pad may be recessed from an outer edge of the container lid thereby to limit access to the actuation pad, making it difficult for a child to operate the actuation pad due to the typical lack of dexterity in small children.

In such embodiments, and without limitation, the container lid may have a convex (upside down U-like) structure, in which it has a central portion, a first lateral portion, and a second lateral portion that are integrally formed together (e.g., part of a single molded piece). The first and second lateral portions may be attached to the central portion at oblique angles, such that the lid has an overall protruding, convex shape in which the central portion is raised relative to the first and second lateral portions (it is to be understood that the term "convex" in this application is not limited to a rounded convex shape, but may include a protruding or bulging shape that includes angles in the surface thereof). The convex structure of the container lid may require that the container lid be compressed and deformed to flatten out the container lid such that the central portion, the first lateral portion, and the second lateral portion are substantially coplanar and the container lid is positioned flush against the upper rim of the container. When positioned flush against the upper rim of the container in the compressed, deformed condition, the container lid may store potential energy which, when the locking pin is moved into the opening position, may cause the container lid to apply force down onto the upper rim of the container and pop open from the upper rim of the container as the container lid resiles to its convex structure.

In such embodiments, and without limitation, the safety container may include an interior rigid shelf (or interior ridge) that is parallel to the upper rim of the container body, and positioned to abut a stepped lip ridge (or sealing lip) on a bottom side of a the container lid when the container lid is closed. Together, the rigid shelf and the lower edge of the lid seal the safety container. Without limiting the invention, the contact between the rigid shelf and the sealing lip may create an airtight seal in the safety container. The compression of the middle section when the lid is in closed position may contribute to a tight seal of the safety container at the interface of the rigid shelf and the lower edge of the lid, preventing contamination and improving preservation of items contained therein. In some embodiments, and without limitation, the safety container may also include a compressible gasket positioned on the interior ridge that contacts the sealing lip when container lid is closed against the rigid shelf of the container. The gasket may assist in providing an air tight seal of the container when the container is closed.

Such embodiments may further have a slide catch mechanism that includes a one or more detents in the pin channel for catching one or more pegs on the locking pin when the locking pin is advanced through the pin channel. The slide catch mechanism may be included as a childproofing feature. In order to overcome the slide catch mechanism, the actuation pad may be pressed down as it is advanced through the pin channel in order to avoid the one or more pegs from catching on the one or more detents.

Other embodiments of the present invention may be directed to safety containers that include a container body and an upper rim portion surrounding a passage in the body, the upper rim having a locking slot formed therein, a container lid having a convex structure and a sealing lip (or ridge) on a bottom side thereof, where the container lid must be compressed into the upper rim of the container body in order to conform to the upper rim and close the safety container; and a locking pin mounted with respect to the container lid and adapted to lockingly engage the locking slot in the upper rim when the container lid is compressed into the upper rim. The container may also include a rigid shelf (an interior ridge) in the container body at an upper end of the passage, the rigid shelf positioned to abut the sealing lip when the container lid compressed into the upper rim and the safety container is closed.

Further embodiments of the present invention are directed to safety containers, that include a container body and an upper rim surrounding a passage in the body; a container lid having a central portion, a first lateral portion, and a second lateral portion, where the central portion, the first lateral portion, and the second lateral portion are integrally, formed, and the first lateral portion is attached to the central portion at a first oblique angle, and the second portion is attached to the central portion at a second oblique angle, where the first oblique angle and the second oblique angle result in the container lid having a convex structure; and a locking pin mounted in the container lid and adapted to move between (i) a locked position lockingly engaging a locking slot in the upper rim; and (ii) an open position disengaging the locking pin from locking engagement with the locking slot, where the container lid must be compressed and deformed to flatten out the container lid such that the central portion, the first lateral portion, and the second lateral portion are substantially coplanar in order to position the container lid flush against the upper rim and close the safety container.

Further embodiments of the present invention are directed toward a method of making a safety container that includes childproof characteristics and can be opened with a single hand, the method including the steps of integrally forming a container having a body and a lid, where the lid is hingedly attached to the body, where the body includes an upper rim having a locking slot therein and the lid has a pin channel therein which includes an distal opening that is adjacent to the locking slot when the lid is closed over the body; integrally forming a locking pin that includes a spring and an actuation pad, and the locking pin may be formed to fit within the pin channel of the body; and inserting the locking pin into a proximal opening of the pin channel and advancing the locking pin through the pin channel until a distal end of the locking pin for engaging with the locking slot is positioned at or near the distal end of the pin channel.

In such embodiments, the container may be formed with a rotatably mounted lid that, is attached to container body on one side and has pin channel opening on an opposite side, at which the locking end of the locking pin may be positioned and lockingly engage the locking slot. The container lid may also be formed to include a locking tab slot within the container lid for receiving a locking tab that may be formed within the upper side of said locking pin. The container lid may also be formed to include a locking tab notch adjacent to the locking tab slot, into which a locking tab may be positioned to prevent the locking pin from being advanced in the pin channel and lock the lid in the closed position.

In such embodiments, and without limitation, the locking pin and the pin channel in the container lid may be formed to have complementary structures, allowing the integrally formed locking pin to be inserted into the pin channel and be secured therein. For example, and without limitation, the pin channel may be formed to include positioning notches (e.g., guiderail necks) therein for receiving and engaging positioning tabs (e.g., angled necks) formed on the outer rails of the locking pin. The positioning tabs may be formed on the lateral surface of the outer rails so that they can pop out laterally to catch a notch or corner in the pin channel. When the locking pin is inserted into the pin channel the positioning tabs may catch in the positioning notches in the pin channel, thereby anchoring the locking pin in the pin channel. In other embodiments and without limitation, the pin channel may have a narrow central channel and a wider channel near the distal end of the pin channel, and the positioning tabs may pop outward and catch at a corner or edge of the narrow central channel.

The locking pin may be formed from a resilient material that allows the locking pin to be compressed and stretched without losing its capacity to return to its original shape. The locking pin may be formed to include a moveable portion that includes an actuation pad and a locking end for engaging a locking slot formed in the upper rim of the container. The moveable portion may be connected to a stationary portion (which includes the outer rails that anchor the locking pin in the pin channel) by an integrally formed spring. The spring may have a proximal section adapted to engage at one end with an abutment (as described above) or other anchoring structure in order to anchor the spring and allow it to be stretched as the moveable portion of the locking pin advances in the pin channel, whereby the spring and the abutment cooperatively bias the locking pin to slide back into the starting position after the actuation pad is released by the user. In some implementations, and without limitation, the actuation pad may be formed to protrude from the container lid to provide a tactile reference point to allow a user to find the actuation pad by touch without the need to visually inspect the safety container. In other implementations, and without limitation, the actuation pad may be formed to be recessed from an outer edge of the container lid thereby to limit access to the actuation pad, making it difficult for a child to operate the actuation pad due to the typical lack of dexterity in small children.

In such embodiments, a locking tab may be formed in the upper portion of the locking pin that is laterally rotatable (e.g., capable of 180° of rotation). The locking tab may be positioned on the locking pin such that when the locking pin is inserted into the pin channel during assembly of the safety container, the locking tab is aligned or substantially aligned with the locking tab slot in the upper surface of the container lid above the pin channel. The locking tab may also be positioned such that it can be rotated to engage a locking tab notch that is formed in the upper surface of the container lid and adjacent to the tab slot. When the locking tab is rotated into the locking tab notch, the locking tab catches on the locking tab notch as the locking pin is advanced in the pin channel, thereby preventing relative movement between the locking pin and the pin channel.

In such embodiments, the container lid may be formed to include three integrally formed sections: a central raised portion, a first lateral portion, and a second lateral portion. The container lid and the rest of the container body may be formed as a single molded piece. The first and second lateral portions may be attached to the central portion at oblique angles with a strong, resilient segment, such that the lid is formed to have an overall convex shape in which the central portion is raised relative to the first and second lateral portions. The convex structure of the container lid may require that the container lid be compressed and deformed to flatten out the container lid such that the central portion, the first lateral portion, and the second lateral portion are substantially coplanar and the container lid is positioned flush against the upper rim of the container. When positioned flush against the upper rim of the container in the compressed, deformed condition, the container lid may store potential energy in the strong, resilient segments between the lateral and central portions, which may cause the container lid to apply force down onto the upper rim of the container and pop open from the upper rim of the container as the container lid resiles to its convex structure when the locking pin is disengaged from the locking slot on the container rim.

In such embodiments, an interior rigid shelf (or interior ridge) may be formed within the container that is parallel to the upper rim of the container body, that is positioned to abut a stepped lip ridge (or sealing lip) formed on a bottom side of a the container lid when the container lid is closed, and that is integrally formed with the container. Without limiting the invention, the contact between the interior rigid shelf and the sealing lip may create an airtight seal in the safety container.

In such embodiments, the method may further include applying a gasket positioned on the interior ridge that contacts the sealing lip when container lid is closed. The gasket may be made from a compressible, resilient material (e.g., santoprene), and may be adapted to contact and force fit with the sealing lip of the container. The gasket may assist in providing an air tight seal of the container when the container is closed.

It is a general object of the present invention to provide a better, more versatile, easily manufactured, and economical safety container.

It is an advantage flowing from the present invention that it provides a container that is more easily utilized by senior citizens and others not requiring use of all safety features at all times.

It is yet an additional advantage of the present invention that it is less likely to be accessible by children, particularly when all safety features are employed by the person who dispenses and by the adult who maintains or uses the container.

It is also an advantage of the present invention that the lid may be biased toward opening, such that when the opening tab is pressed, the lid pops upward, opening the container.

Conversely, another advantage is that the container may be adjusted to provide a high level of safe closure (vis a vis children) when and if access by children becomes a concern.

Yet another advantage is that the present invention may be opened without actually completely separating the cap from the container and perhaps losing the cap or misplacing it with the wrong cap.

An additional advantage is that the user is less likely to fail to re-close the present container.

A further advantage is that present invention does not require great dexterity on the part of an adult or the use of a fingernail in order to open and close the cap.

A related advantage is that the present invention can be set to require multiple separate finger motions in addition to a motion to open the container. This renders the cap quite difficult for children, and people who may not appreciate the danger of misuse of the contents, to gain access to the contents of the container without the aid of a capable adult.

It is also an advantage of the present invention that the cover or lid locking mechanism automatically locks the lid in closed position on the container with one simple hand motion and without need for difficult pushing and/or twisting motions by the user.

It is a further advantage of the present invention that the lid may create an air tight seal of the safety container when the lid is in the closed position.

The present invention thus provides a safer, economical, easily manufactured, easily used, and versatile container for potentially hazardous materials.

There are other objects and advantages of the present invention. They will become apparent as the specification proceeds. It is to be understood, once again, that the scope of the present invention is to be determined according to the accompanying claims and not by whether a given embodiment achieves all the objects and advantages recited herein.

The above-described objects, advantages and features of the invention, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
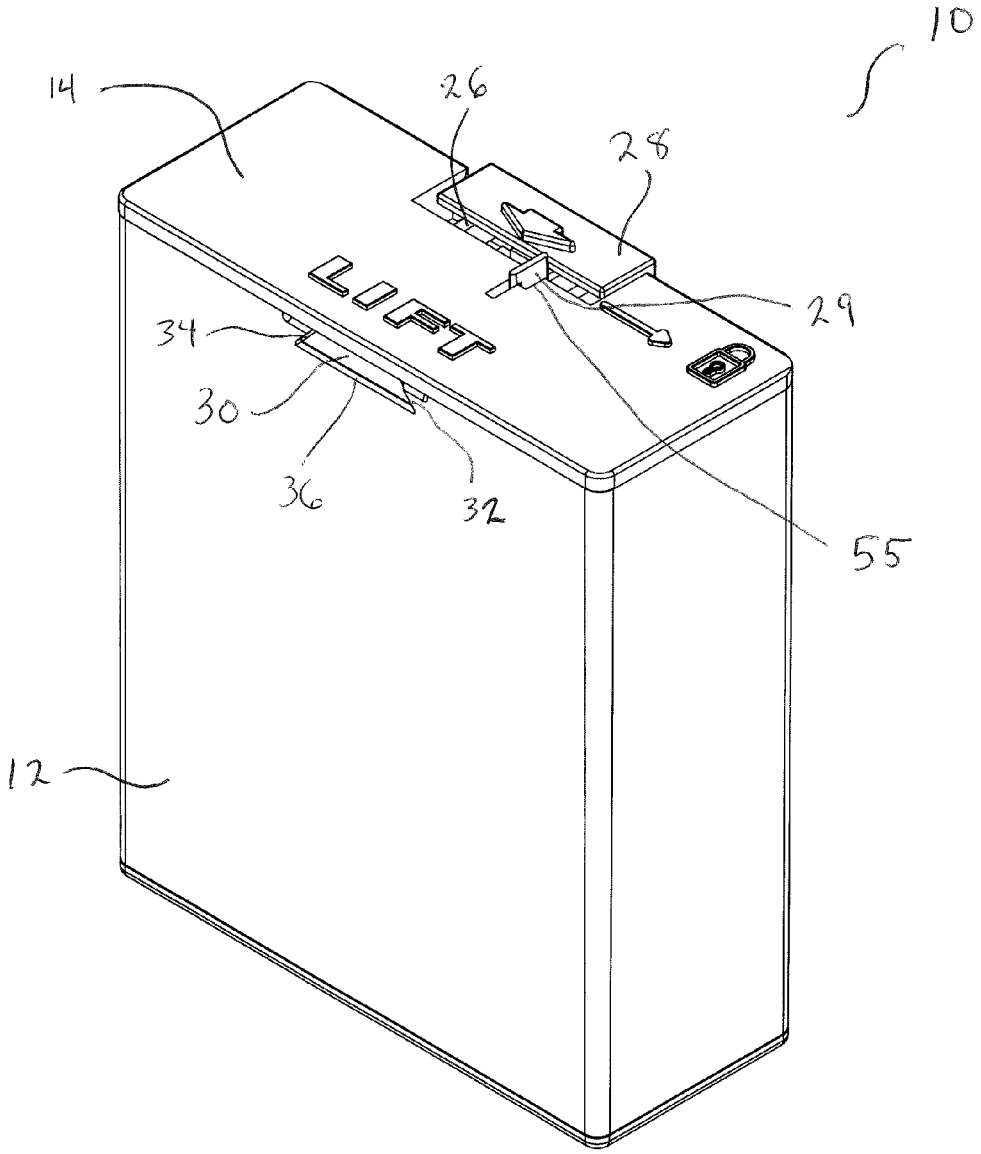
FIG. 1 is a perspective view of a safety container according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without all of these specific details.

The present invention concerns safety containers for various substances that are unsafe for children, such as pharmaceuticals. The safety containers of the present invention may have several functional features that provide improvements over prior art safety containers, including, and without limitation, (1) a locking pin that can be operated with one hand (e.g., with one's thumb) to release a lid of the safety container from a closed position, (2) a locking tab that prevents the container from being opened when it is in the locked position and that can be operated with one hand (e.g., one's thumb), (3) a slide catch mechanism that catches the locking pin as the locking pin is advanced in the pin channel and requires that the user press down on an actuation pad in order to overcome the slide catch mechanism, and (4) a lid that is biased to pop open when the locking pin releases the lid from the closed position. These and other features of the safety containers of the present invention improve the functionality of the safety containers such that they are easily operable and convenient, while maintaining childproof characteristics.

The above-discussed aspects of the present invention and additional aspects of the present invention are described below in reference to the embodiments illustrated in the accompanying, drawings. The drawings use like reference characters to designate like or corresponding parts throughout the several views.

Without limiting the invention, embodiments of the present invention may be directed toward a safety container that includes a container body and a lid. The container body and the lid may be integrally formed (e.g., from the same mold) and may be made from a plastic material. For example, and without limitation, the container may be made from a polymeric suitable for storing pharmaceuticals. In some embodiments, and without limitation, the container may be made from a composition that includes Polypropylene (PP). For example, the container may be made from composition that is all or substantially all PP. In another example, the container may be made from a mixture of PP with another polymeric material. The mixture may include 50% or more of PP by weight 50% or more PP by volume, or 50% or more PP by mole fraction. The mixture may additionally contain polyethylene (PE, such as High Density PE [HDPE], Low Density PE [LDPE]). In some example, the container may be made from other polymeric materials, such as Polyethylene Terephthalate (PET), Polyvinyl Chloride (PVC), Polystyrene (PS), Flourine Treated HDPE, mixtures thereof, mixtures of such polymers with PP and/or PE, or other suitable material. The container body may have an open passage at a top end and may have a rectangular prism shape, a trapezoidal prism shape, or other appropriate shape. Without limiting the invention, the open passage at the top of the body may be rectangular. As an example, and without limitation, FIG. 1 shows an example safety container 10 according to embodiment of the present invention, which includes a rectangular box shaped body 12 and a hinged, generally rectangular lid 14 for safely closing the container 10 and opening it, to remove material (not shown) or insert material into the container 10. The container body 12 has four generally rectangular sides extending from a generally rectangular floor or bottom side and joined at the corners of the rectangular floor. Without limiting the invention, the container body 12 may have the shape of a rectangular prism, a trapezoidal prism, or various other shapes.

The safety container of the present invention may also include a locking pin that may be inserted into a pin channel formed in the container lid. The locking pin may include a locking end for engaging a locking slot in the upper rim of the container body near the open top end of the container, an actuation pad to which a user may apply pressure to advance the locking pin through the pin channel, a spring for biasing the locking pin, a locking tab for preventing the locking pin from being advanced through the pin channel when the locking tab is in the lock-out position, a slide catch protrusion on the upper portion of the locking pin within the slideway for catching a detent in the roof of the slideway, and various structures (e.g., positioning tabs) for anchoring the locking pin within the pin channel. The locking pin may be integrally formed (e.g., using a single mold) and may be made from a suitable polymeric material such as PP, or a mixture of PP as described above in relation to the material of the container. Without limiting the invention, other materials that may be used to form the locking pin include HDPE, LDPE, acetal, acrylonitrile-butadiene-stryene [ARS], PET, PVC, PS, Flourine Treated HDPE, and other suitable material. In some embodiments, the locking pin may be made from the same material as the container and lid. In other embodiments, the locking pin may be made from a different material than the container and lid.

Figure 5:
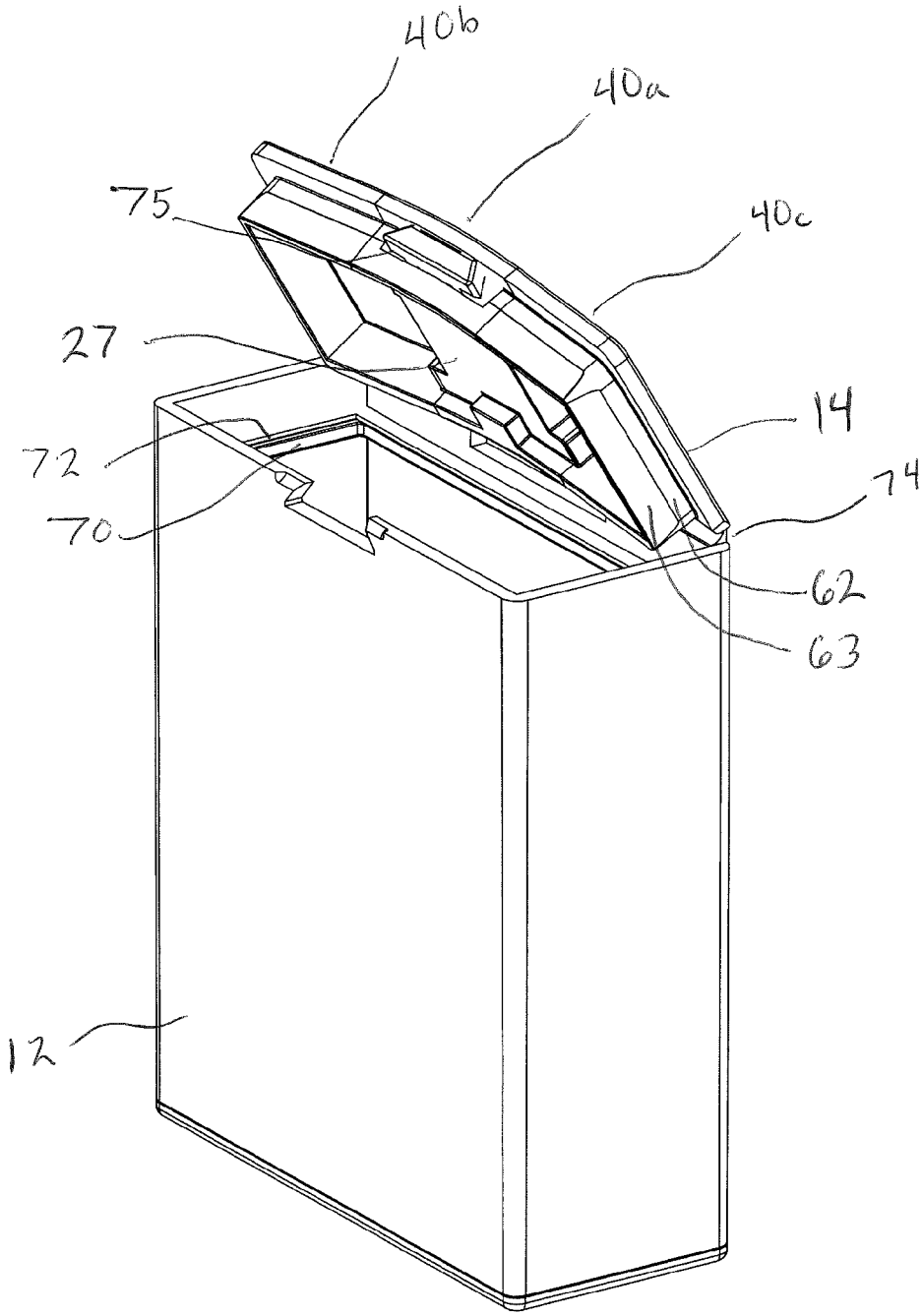
FIG. 5 is a perspective view of an upper section of a safety container according an embodiment of the present invention, showing the safety lid in an open position.
Figure 8:
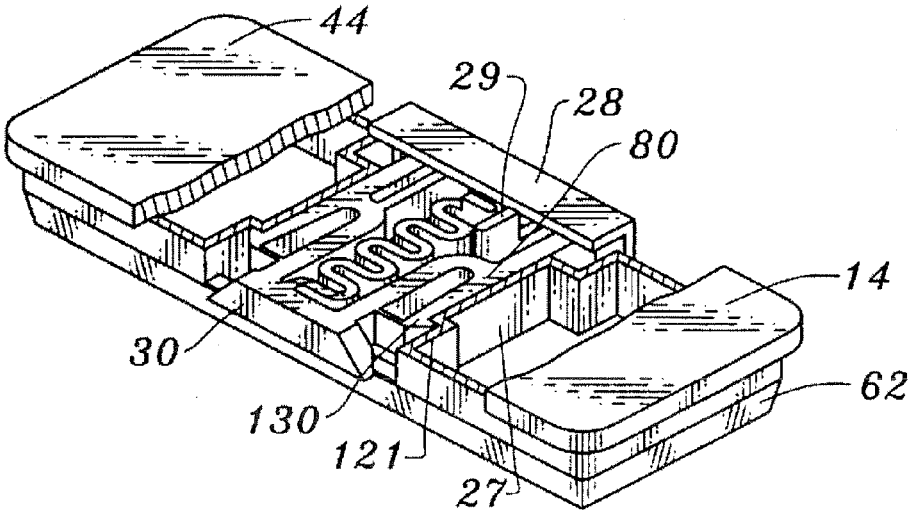
FIG. 8 is a perspective view of a container lid according to an embodiment of the present invention, showing a portion of the uppermost planar top section of the container lid removed to reveal the interior structure of the lid and the associated locking pin.

To illustrate, and without, limiting the invention, FIG. 1 shows the hinged lid 14 having a locking pin 26 slidably mounted along the plane of the lid 14 in a slideway 27 (shown in FIG. 8). The bottom of the slideway 27 is also shown in FIG. 5 on the underside 25 of the lid 14. The locking pin 26 may have a finger actuation pad 28 on one end of the locking pin 26 opposite a dovetail end 30 on the other end of the locking pin 26. The dovetail end 30 may retain the lid 14 in its closed position, as shown FIG. 1, when the dovetail end is mated with locking slot 36 and abuts opposing locking necks 32, 34 in medial portion of the upper lip of the container body 12 to form a strong dovetail joint. When the dovetail end 30 is mated with the locking slot 36, the lower edge of the hinged lid 14 may securely abut to the upper lip of the container and seal the compartment of container 10. The dovetail end 30 may be contoured as an isosceles trapezoid with the equal sides canted upwardly and inwardly. The locking necks 32, 34 may be complementarily formed such that the locking necks 32, 34 are flush with the lateral, canted sides of dovetail end 30 and hold dovetail end 30 securely in the locking slot 36. Collectively, dovetail end 30 and neck 32, 34 may define a dovetail lock having considerable strength.

Figure 2:
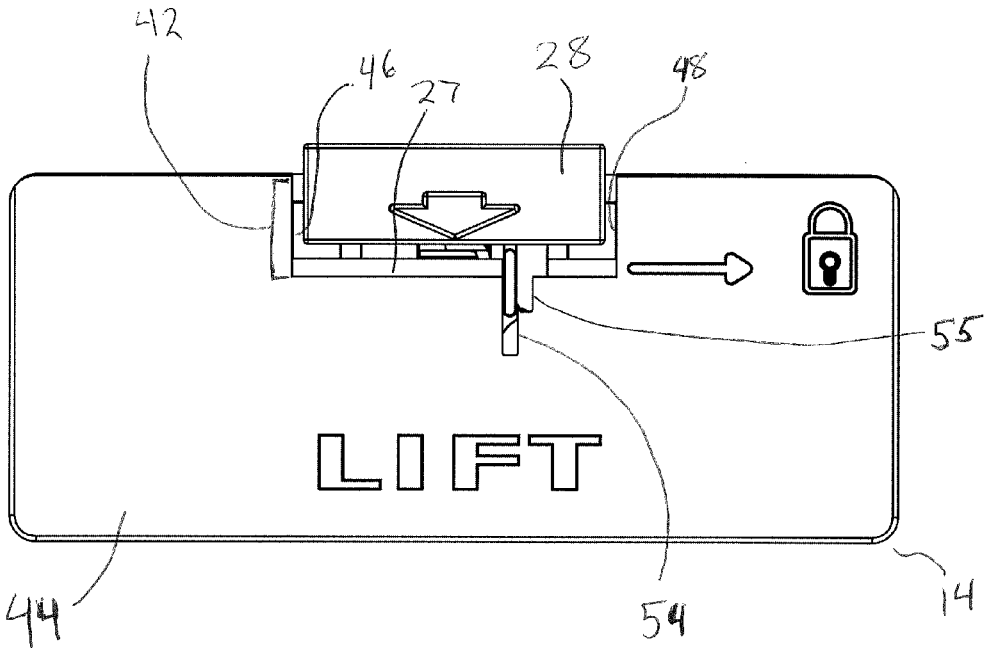
FIG. 2 is a top-down view of the top of the cover or lid of a safety container according to an embodiment of the present invention.

Referring now to FIG. 2, and without limiting the invention, the hinge lid 14 may have an actuation pad channel 42 that may be recessed in the upper surface of the lid 14 and may be adjacent to the slideway 27. The actuation pad 28 may slide in the pad channel 42 in order to change a position of locking pin 26 mounted in the slideway 27 (e.g. from a closing position to an opening position).

Figure 3:
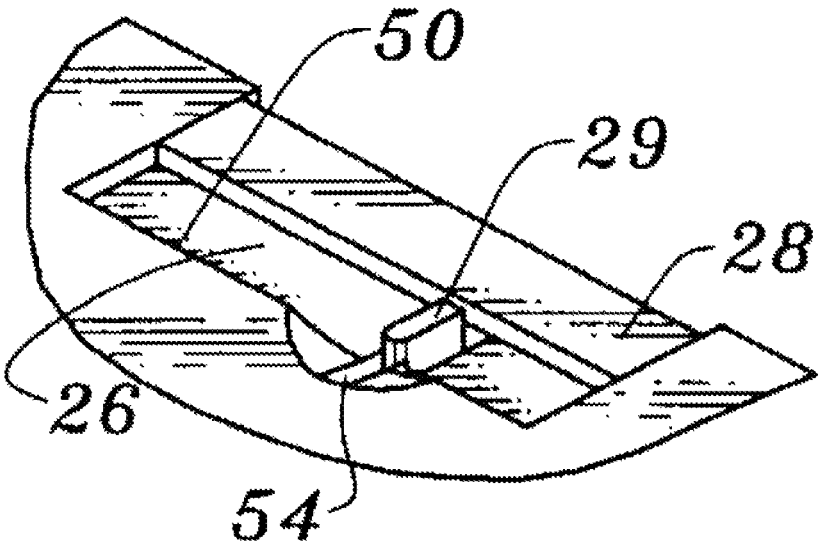
FIG. 3 is a perspective view of a portion of a top of a lid of a safety container according to an embodiment of the present invention, showing the locking tab in the unlocked position.

The pad channel 42 has two opposing, parallel channel sides 46, 48 interconnected by a pad abutment or stop edge 50 perpendicular to the opposing channel sides 46, 48. The portion of the upper surface 44 of the lid 14 immediately adjacent to the pad abutment 50 may have a finger access depression 52 (e.g., a semicircular or half-moon, concave depression, as shown in FIG. 3). The depression 52 may be centered on the abutment 50 between the two channel sides 46, 48, or it may be offset from the center of the abutment 50 to one side or the other. In other embodiments, no such depression may be present.

The container 10 may also have a locking tab 29 and a locking tab slot 54. The locking tab slot 54 may extend perpendicularly from the edge of abutment 50 and pad channel 42. In some embodiments, the locking tab slot may pass through the depression 52. The position of the locking tab slot 54 may be coordinated with the position of a rotatable locking tab 29 that may be part of the locking pin 26. The container may also include a locking tab notch 55 that may be formed adjacent to the locking tab slot 54 in an upper surface of the container lid.

Without limiting the invention, the locking pin 26 of the exemplary container 10 shown in FIGS. 1-5 may include a rotatable locking tab 29 extending vertically upwardly from the locking pin 26 and adjacent to the finger actuation pad 28 on the locking pin 26. The locking tab 29 may be positioned such that it aligns with the locking tab slot 54 when the locking tab is in the unlocked position. The locking tab may be rotatable such that it can be positioned to be aligned with tab slot 54 or it may be rotated to engage locking tab notch 55 to thereby prevent the locking pin 26 from being advanced through the slideway 27.

Figure 4:
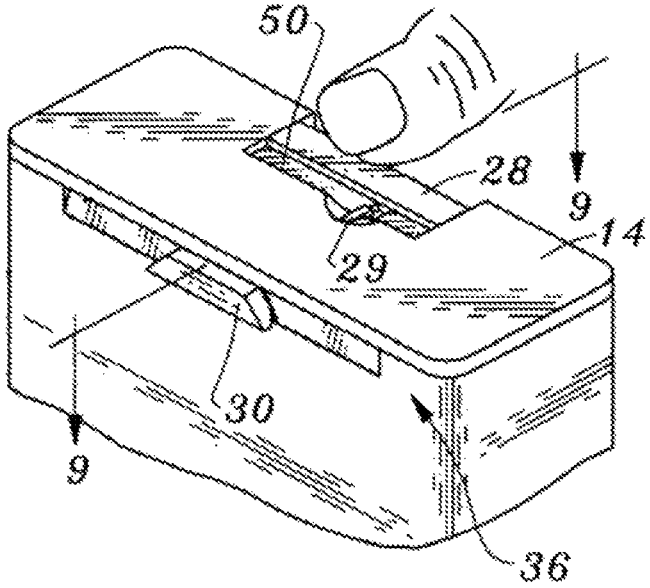
FIG. 4 is a perspective view of an upper portion of a safety container according an embodiment of the present invention, showing how a person may use a thumb or finger to push and slide a locking pin into the opening position.

In some implementations, and without limiting the invention, the locking tab may be required to align with the locking tab detent formed an upper surface of the container lid, thereby avoiding obstruction of the locking tab and allowing the locking pin to be advanced in the pin channel from the closing position to the opening position. In the exemplary container 10 shown in FIGS. 1-5, the locking tab 29 must be aligned with the opposing tab slot 54 in order for the finger pad 28 and associated locking tab 29 to move toward the abutment 50. In order to so align the locking tab 29, the user can use a finger to rotate and translate the locking tab 29 so that it is generally co-planar with the tab slot 54, as shown in FIG. 3. With the locking tab 29 and the tab slot 54 in alignment, the locking tab 29 can penetrate the tab slot 54 when, as shown in FIG. 4, the user undertakes a second finger motion, pushing the finger pad 28 on the locking pin 26 toward the pad abutment 50. By thus pushing the pad 28 and associated pin 26 to slide in the slideway 27, the opposite dovetail end 30 is forced outwardly from engagement with the locking slot 36 in the upper lip of the container body 12.

In contrast, if the locking tab 29 is rotated into engagement with the locking tab notch, the locking pin will be obstructed and will not be able to advance in the slideway 27. The locking tab may be operable to rotate between a lock-out position in which it is engaged with the locking tab notch and an open position in which it is aligned with locking tab slot. The user must be able to operate this safety feature in order to open the container, if the locking tab is in the lock-out position.

In some embodiments, and without limitation, the lid may have a convex profile, in which the lid has a raised central portion and two lateral portions attached thereto. The lateral portions may be attached to the central portion at oblique angles, such that the lid has an overall convex shape in which the central portion is raised relative to the first and second lateral portions. The convex structure of the container lid may require that the container lid be compressed and deformed to flatten out the container lid such that the central portion and the lateral portions are substantially coplanar and the container lid is positioned flush against the upper rim of the container. When positioned flush against the upper rim of the container in the compressed, deformed condition, the container lid may store potential energy which, when the locking pin is moved, into the opening position, may cause the container lid to apply force down onto the upper rim of the container and pop open from the upper rim of the container as the container lid resiles to its convex structure.

For example, and without limitation, FIG. 5 shows lid 14 having a central raised section 40*a* and lateral sections 40*b* and 40*c*. The central section is raised relative to the lateral sections 40*b* and 40*c*, giving the lid 14 a convex profile. In some embodiments, and without limitation, due to the convex profile of the lid 14, the lid 14 must be compressed and deformed in order place the lid in a closed position in which the lid 14 is flush against the upper lip of container body 12 (e.g., as shown in FIG. 1). The lid 14 may remain in the closed position despite the compression applied to the lid 14 due to the engagement of the dovetail end 30 with the locking slot 36. The deformation of the lid may result in potential energy stored in the lid that biases the lid toward the open position, such that when the dovetail end 30 is disengaged from the locking slot 36, the lid 14 pops open. This functionality of the container allows a user to easily open the container with one hand. However, the container is still lockable and requires multiple finger movements to open, thereby providing child-proofing characteristics.

In other implementations, and without limiting the invention, the container lid may be biased toward an open position by other mechanisms, such as a spring-biased lip that is present around and outer edge of the container lid that is compressed when the lid is pressed into a closed position. In still further implementations, and without limitation, the container lid may be biased to open by a spring that is attached to said container lid at one end and to the interior of the container body, biasing the container lid to the open position.

In other embodiments, and without limitation, the container lid may have a flat profile without a raised section. In such embodiments, the lid may not be biased toward an open position, and the user may use a hand motion (e.g., a thumb motion, or the user's other hand) to rotate the non-hinged, opening end of the hinge lid radially upwardly away from the container lip. In this fashion, the user may open the container and gain access to the interior of the container and the container body.

With continuing reference to FIG. 5, the lid 14 may have a stepped lip ridge 62 extending perpendicularly from the plane of the underside 25 of the lid 14. The lip ridge 62 is spaced inwardly from the outer edge of the lid 14 so that the ridge 62 provides a force-fit against the interior of the container 12. Toward this end, the interior side walls may have a mating rigid shelf 70. The rigid shelf 70 may be formed as a protruding band of plastic that runs just below the locking slot 36 and around the entire interior of the container 10. The rigid shelf 70 may positioned below an upper edge of the container body 12 at a distance that is equal to the width of lip ridge 62, such that the lip ridge 62 can be completely inserted into the container body 12 and the outer edge of lid 14 can be pressed flush against the upper edge of container body 12. The meeting of the ridge 62 of the lid 14 with the rigid shelf 70 of the container may result in an air tight seal of the safety container 10. The pressure created by the compression of the convex lid 14 may exert sufficient pressure to create the airtight seal.

Figure 6:
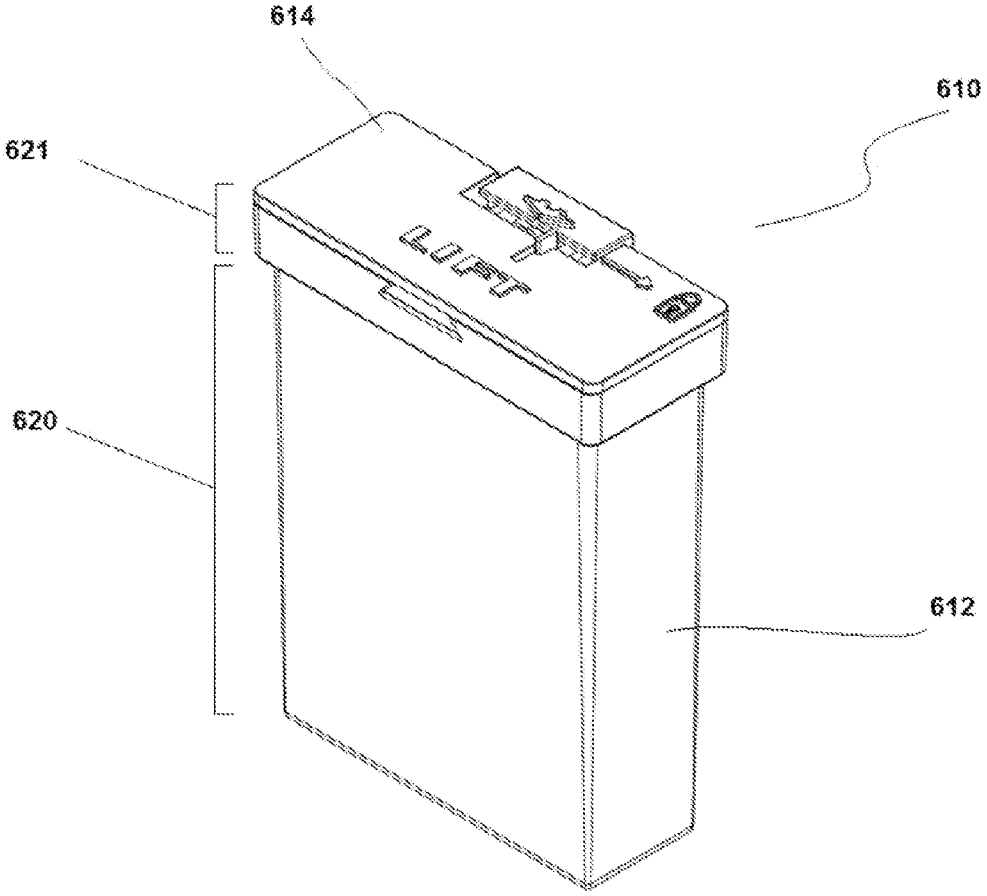
FIG. 6 is a perspective view of a safety container according to an embodiment of the present invention.

In other embodiments, and without limitation, the rigid shelf may be formed as inner most layer of the container body, such that inner width and depth dimensions of the container body may be substantially the same from the rigid shelf to the bottom of container body. For example, FIG. 6 shows an alternative embodiment of a safety container, container 610 having a container body 612. A lower portion 620 of the container body 612 has a smaller cross sectional area than an upper portion 621. The difference between the cross-section areas of the lower portion 620 and the upper portion 621 creates a rigid shelf where the lower and upper portions meet. The lip ridge of the lid 614 may have a vertical dimension that is equal to the depth of the upper portion 621 of the container body 612 such that the lip ridge is pressed flush against the rigid shelf within the container body 612 when the lid 614 is closed over the container body 612. In further embodiments, and without limitation, the rigid shelf may be formed such that it is vertically continuous to the bottom of the container, such that the internal wall of the container is thicker from the rigid shelf down to the bottom of the container than it is near the opening of the container. In still further embodiments, and without limitation, the interior wall of the container may be tapered, such that the thickness of the wall is thickest at the rigid shelf and the thickness tapers from the rigid shelf down toward the bottom of the container. Other configurations of the rigid shelf and the sidewalls of the container are also contemplated within the scope of the present invention.

Referring back to FIG. 5, the container 12 may also include as an interiorly peripherally circumscribing gasket 72 comprising a compressible resilient material (e.g., santoprene), which may contact the stepped lip ridge 62 as the lid 14 is closed on the container 12. The gasket may be formed on the rigid shelf 70 around the entire internal perimeter of the container 12. The gasket 72 may contribute to an air tight seal when the lid 14 is closed over the container 12.

As shown in FIG. 5, the lid 14 is permanently mounted on the container body 12 by a hinge 74 on the hinged side of the lid 14 opposite its opening end. The structure and operation of the hinge 74 may be biased, e.g., by the convex profile of the lid 14, such that the lid starts to rotate open once the dovetail end 30 is clear of the locking slot 36. In other embodiments, and without limitation, the lid may be biased by other mechanisms such as a spring hinge (not shown). In further embodiments, and without limitation, the lid may have a tab (not shown) extending from the hinged side of the lid that may allow the user of the container to press down on the tab (e.g., with the user's thumb) to pop the lid open, thereby allowing the user to open the container without the need of two hands.

A locking pin slideway 27 may extend from the underside of the lid 14 perpendicularly between the opening end and the hinged side of the lid 14 to abut and penetrate the stepped lip ridge 62 at each of the two opposing ends of the slideway 27. The dovetail end 30 thus extends through the opening-side slideway passage 75 penetrating the stepped lip ridge 62 on the opening end of the hinge lid 14.

Without limiting the invention, FIGS. 7-10 present an exemplary locking pin and associated structures for inclusion in a container according to an embodiment of the present invention. The locking pin may be an integral, unitary structure molded from a strong, flexible, and resilient polymeric material (e.g., PP, HDPE, LDPE, acetal, ABS, PET, PVC, PS, Flourine Treated HDPE, or other suitable material, etc.). Such materials may allow for the thinner sections in the locking pin to maintain the functionality and structure through extended and repeated use. The locking pin may be a separate, unitary structure from the container lid, and may be inserted into a locking pin, slideway formed in the lid. The locking pin slideway in the lid of the container may be a tunnel-like structure that encompasses and surrounds a substantial portion of the locking pin, when the locking pin is inserted into the slideway. The lid may also be a unitary, molded structure having the slideway formed therein.

Figure 7:
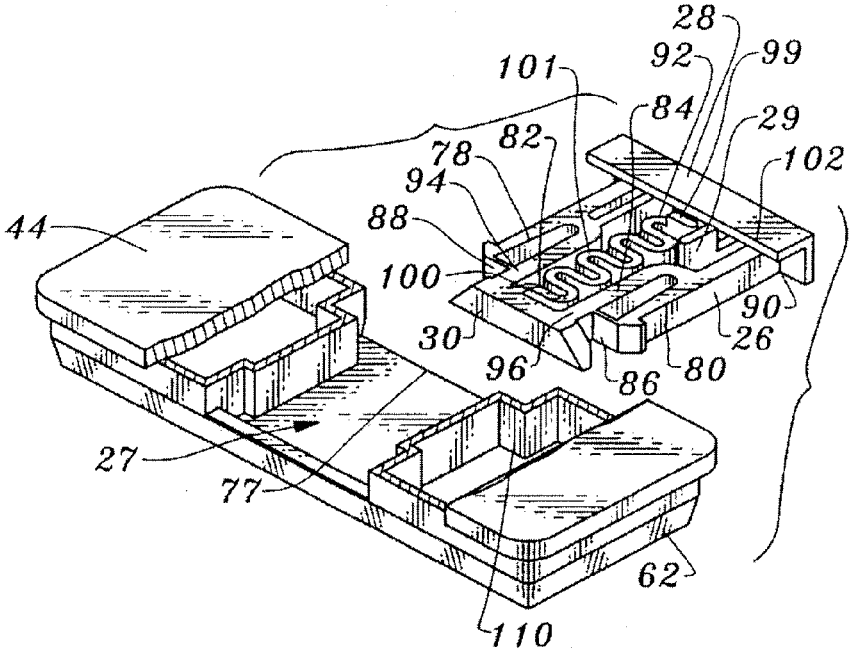
FIG. 7 is a perspective view of a container lid and a locking pin according to an embodiment of the present invention, the container lid and locking pin as shown prior to insertion of the locking pin into a pin channel in the container lid.

Without limiting the invention, FIG. 7 shows exemplary locking pin 26 and lid 14 having a slideway 27. In FIG. 7, the locking pin 26 and the slideway 27 are decoupled from each other for illustrative purposes. The locking pin 26 may have two parallel, opposing guide rails 78, 80 extending perpendicularly from the actuation pad 28. Two interior support rails 82, 84 may extend respectively from and between the opposing guide rails 78, 80. The interior support rails 82, 84 may also extend substantially parallel to the guide rails 78, 80 and beyond the guide rail ends 86, 88 opposite the intersection or junction 90 of the guide rails 78, 80 with the actuation pad 28. The support ends 94, 96 of the support rails 82, 84 may extend past the guide rail ends 86, 88 and may also perpendicularly intersect, join, and support the transversely extending dovetail end 30.

As shown in FIG. 8, the locking pin 26 may be slotted into the slideway 27 to provide multiple locking mechanisms for the safety container 10. The locking pin 26 may be snapped into position within the slideway by positioning tabs. For example, and without limitation, locking pin 26 includes angled necks 130 and 132 on outer rails 78 and 80, which snap into position on guiderail necks 120 and 121 (see also FIG. 10). In other embodiments, and without limitation, the locking pin may be fitted into the slideway by other mechanisms, e.g., the sidewalls of the slideway may have protrusions formed therein and the outer guide rails may have notches into which the slideway protrusions engage.

Once the locking pin is established in the slideway, the locking pin is operable to function as a locking mechanism for the container lid, where a user of the safety container can apply pressure, to the actuation pad to move the locking pin from a locked position to an open position to allow the lid to open. The locking pin may include a spring structure for biasing the locking pin to return to a locked position when no pressure is applied to the actuation pad of the locking pin. As shown in FIG. 7, and without limiting the invention, the locking pin 26 may include an S-shaped spring member 92 having a plurality of "S" shaped serpentine bends extends from the dovetail end 30 toward the actuation pad 28, and is intermediate between the opposing support rails 82, 84. The S-body 101 of the S-spring 92 lies between and in a plane parallel to the support rails 82, 84. A spring lip 99 extends perpendicularly from the plane of the S-spring 92 at the spring end 98 of the S-spring 92 opposite the fixed end 100 of the S-spring extending from the dovetail end 30. The spring end 98 securely abuts a pad neck 112, to prevent the spring end 98 from advancing into the slideway 27 when a user applies pressure to the actuation pad 28 and advances the rest of the locking pin 26 into the slideway 27. The spring lip 99 may be a plate or tab structure unitarily formed with the spring end 98 (and the rest of the locking pin structure) or may be a subsequently attached structure. The slideway 27 may include a pad neck 112 in the superior portion of the slideway 27 and/or a medially-positioned slot in the inferior portion of the slideway 27, either or both of which may be configured to engage with the spring lip 99 and prevent the spring end 98 from being advanced into the slideway 27. In some embodiments, and without limitation, the spring lip may be fixed to either or both of pad neck and the medially positioned slot in the slideway. In still further embodiments, the spring lip may be anchored to some other structure in the container lid to allow the spring to be stretched from spring end 98 as the locking pin is advanced through the slideway, thereby biasing the locking pin to return to closing position. The spring lip or stop 99 may also be perpendicular to the plane of the locking tab 29 and adjacent and parallel to the interior edge 102 of the actuation pad 28.

It is to be understood that the spring of the locking pin may alternatively be a separate structure added to the locking pin structure after the locking pin is formed. For example, and without limitation, a coil spring, a flat spring, or other form of spring, made from various resilient materials (e.g., steel, polymeric material, etc.), may be installed into the locking pin after the locking pin is formed. A spring lip structure may be added to the end of the separate spring (e.g., a pad or plate made from metal, polymeric material, etc.) to enable the separate spring to engage with a pad neck or other structure that prevents the spring end from advancing into, the slideway when the actuation pad of the locking pin is advanced by the user.

Figure 9:
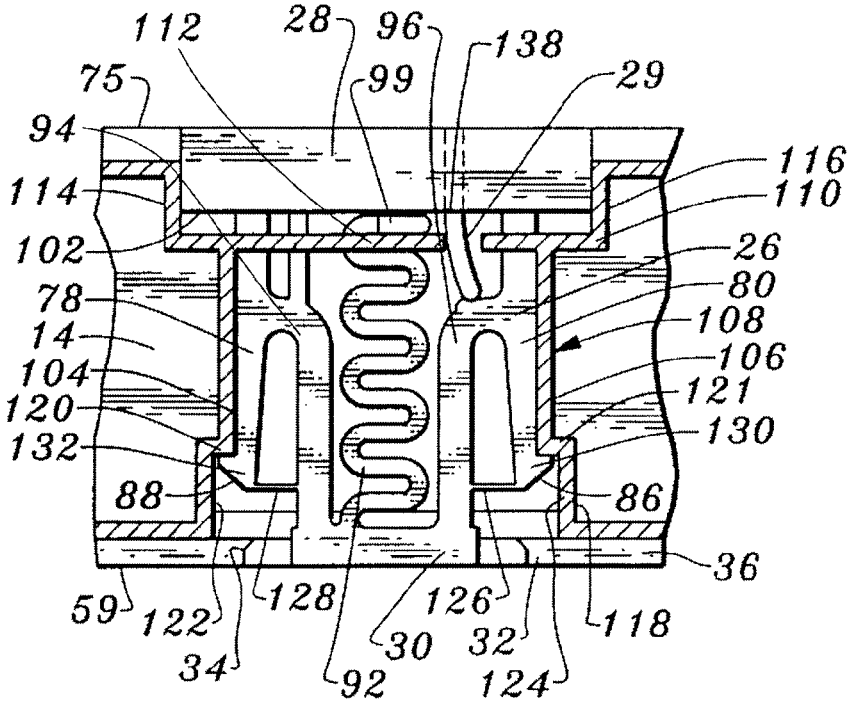
FIG. 9 is a cross-sectional view of the lid of FIG. 1 taken along a plane parallel to and immediately below an upper surface of a container lid according to an embodiment of the present invention, showing a locking tab in the lockout position.

Referring now to FIG. 9, the slideway 27 may have two central, parallel opposing sides 104, 106 providing a central side boundary, 108 for the slideway 27. The opposing slideway sides 104, 106 may be parallel to, and slidably abut, the mating guide rails 78, 80 on the locking pin 26 when the locking pin 26 is mounted in the slideway 27. The slideway 27 may also have a widened actuation pad passage section 110 co-extensive with, as shown in FIG. 9, the actuation pad channel 42 in the upper surface 44 of the lid 14. The widened pad passage section 110 of the slideway 27 may therefore be at the end of the central side boundary 108 adjacent the hinged end of the lid 14. The junction of the narrower central side boundary 108 and the widened actuation pad passage 110 may provide an integrally molded pad neck 112 that is: (i) perpendicular to the sides of slideway sides 104, 106 and the adjacent sides 114, 116, respectively, of the actuation pad passage 110, and (ii) parallel to the interior edge 102 of the actuation pad 28 when the locking pin 26 is mounted in the slideway 27.

The slideway 27 may also have a widened dovetail end passage section 118 at the end of the central side boundary 108 adjacent the opening end or side 59 of the lid 14. The junction of the narrower central side boundary 108 and the widened actuation dovetail end passage 118 may provide integrally molded, opposing guide rail necks 120, 121 extending perpendicularly from, and interconnecting, the sides of slideway sides 104, 106 and the adjacent sides 122, 124, respectively, of the dovetail end passage 118.

The guide rail ends 86, 88 may have (i) thin web spring supports 126, 128 transversely interconnecting the ends 86, 88, respectively, with their associated support rails 96, 94, and (ii) angled necks 130, 132 extending respectively from the support springs 126, 128 transversely outwardly from their mating guide rails 80, 78, respectively. Without limiting the invention, and with respect to the embodiment shown in FIGS. 7-10, when the locking pin 26 is mounted in the slideway 27 without any deformation of the S-spring 92, the angled necks 130, 132 (which act as positioning tabs) thus abut and fixedly grip, the guide rail neck 120, 121, acting as unidirectional insertion barbs, thwarting removal of the locking pin 26.

In some embodiments, the lid and the locking pin are separately formed having complementary shapes. The combination of the locking pin and the lid may be assembled by sliding the locking pin into the slideway to the point that the insertion barbs emerge past the guide rail neck, thereby locking the locking pin into the slideway. For example, and without limitation, the locking pin 26 may be initially installed as shown in FIG. 7 by sliding the pin 26 from right to left into the slideway 27. The web spring supports 126, 128 may resiliently flex in when the locking pin 26 is slide-mounted (installed) into the slideway 27 by inserting and sliding the dovetail end 30 of the locking pin 26 into the slideway 26. When the locking pin 26 is so inserted, into the slideway 27, the angled necks 130, 132 may be forced to flex toward each other by flexion of their associated web spring supports 126, 128 as the angled necks penetrate and slide through the central slideway boundary 108 and may thereafter expand into widened necks 120, 121. The insertion of the locking pin 26 through the slideway 27 to the point where angled necks 130, 132 advance past the guide rail neck 120, 121 locks locking pin 26 into place in the slideway 27, as shown in FIG. 9. The locked position of the locking pin 26 anchors the locking pin 26 within the slideway 27 so that the actuation pad 28 can be used to move the dovetail end 30 in relation to the locking slot 36.

Still referring to FIG. 9, when the locking pin 26 is mounted in the slideway 27, the spring lip 99 may abut the pad neck 112. In some embodiments, and without limitation, the spring lip 99 may be fixed to the pad neck 112 (e.g., heat welded, glued, or otherwise fixed to the pad neck 112). The pad neck 112 thus restrains the spring lip 99 from entering the central slideway boundary 108. As a result, spring-biasing may be provided by the integral S-spring 92 that naturally urges or biases the integral angled necks 130, 132 toward abutting engagement with their respective guide rail necks 121, 120, which in turn biases the integral actuation pad 28 outwardly and may space the actuation pad 28 apart from the slideway boundary 108 and stop edge 50. Similarly, the S-spring 92 may simultaneously bias the dovetail end 30 into a locking, force-fit engagement with the opposing, inwardly angled locking edges 32, 34, respectively, in the locking slot 36 (see also FIG. 1). When the spring 92 is pushed as in FIG. 10, it may expand and stretch, thereby storing potential energy which may cause the spring to want to retract to the closing position as shown in FIG. 9.

As discussed above, the lid of the container may include a locking tab for restricting the movement of the actuation pad, and thereby preventing the disengagement of the lid lock from the corresponding locking slot in the container. With continuing reference to FIG. 9, and without limiting the invention, the locking tab 29 may resiliently flex about an axis perpendicular to the plane of the S-spring 92. The locking tab 29 may thus be flexed or bent into an angled, lock-out position (by a finger motion) and retained in the lock-out position by a tab locking notch 138 extending outwardly thereby defining a locking tab retainer, in the direction of the locking tab 29, from the rounded periphery of the junction of the guide rail 80 and the integral support rail 96. In the lock out position shown in FIG. 9, the flexed locking tab 29 cannot penetrate the locking tab slot 54 in the hinged lid 14. As a result, the dovetail end 30 may be locked in interlocking relationship with the locking edges 32, 34 in the locking slot 36 of the container body 12. The lid 14 may be thereby locked in the closed position, as shown in FIG. 9. In other embodiments, the upper surface of the lid may have a locking tab notch or recess adjacent to the locking tab slot, and into which the locking tab may be tightly positioned and form fitted to retain the locking tab in the notch or recess.

Figure 10:
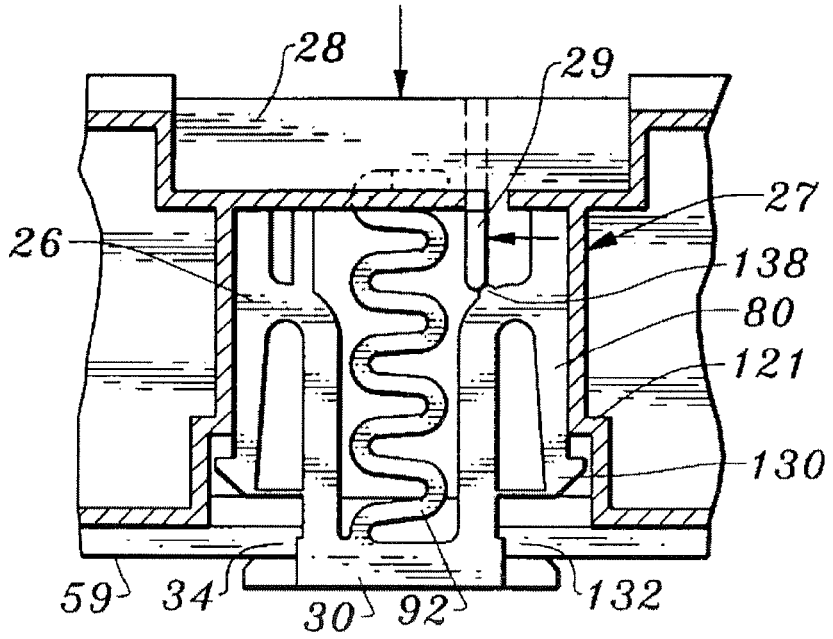
FIG. 10 is a cross-sectional view of the lid of FIG. 1 taken along a plane parallel to and immediately below an upper surface of a container lid according to an embodiment of the present invention, showing the locking tab in an unlocked position and a locking pin in the opening position.

Referring now to FIG. 10, the locking tab 29 may be rotated into the straightened or non-flexed position, by pushing the tab 29 to flex around, and thus resiliently move past, the tab locking notch 138. In its non-flexed position, the resilient locking tab 29 may be aligned with the mating tab slot 54. In this alignment of the locking tab 29 into an unlocked position, the user may employ a firm second hand motion, such as shown in FIG. 4, to push against the actuation pad 28 and thereby: (i) expand (stretch) the S-spring 92, (ii) slide the locking tab 29 into the tab slot 54, and (iii) push the dovetail end 30 outwardly from force-fit engagement with the locking slot 36 of the container and its associated locking edges 32, 34. Once the dovetail end 30 is clear of the lock slot 36, the potential energy stored in the lid 14 due to the compression of the convex shape of the lid 14 may cause the lid 14 to pop open, such that the lid 14 rotates radially upward on its hinge without the need for the user to apply force to separate the lid 14 from the upper lip of container 12 (see, e.g., FIG. 5).

Figure 11A:
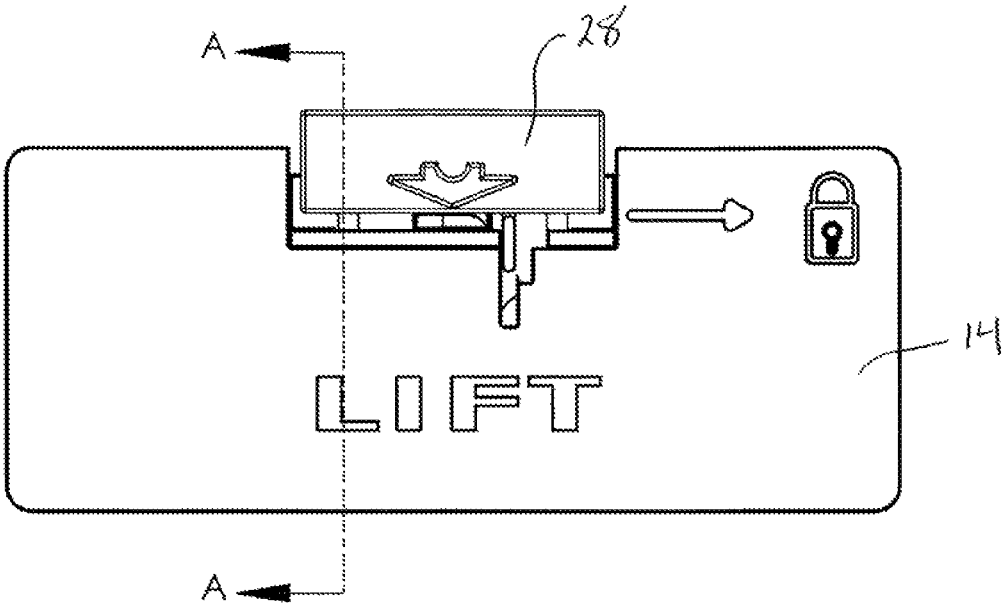
FIG. 11A is a top-down view of the top of the cover or lid of a safety container according to an embodiment of the present invention.
Figure 11B:
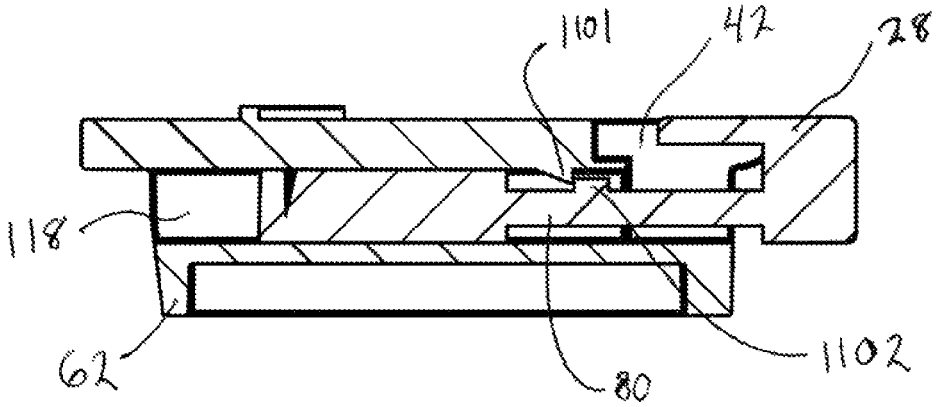
FIG. 11B is a cross-sectional view of an upper portion of a safety container according to an embodiment of the present taken along section line A-A of FIG. 11A, showing a slide catch mechanism in the container lid.

FIGS. 11A-11B show an example of a slide catch mechanism that may be included as a safety feature in the safety container 10. FIG. 11A shows a view of the top of a lid 14 of safety container 10, and a section line A-A therethrough, which defines the cross-sectional view of FIG. 11B. FIG. 11B shows a cross-sectional view of lid 14 along section line A-A, which includes actuation pad 28, pad channel 42, guide rail 80, and dovetail end passage 118. Additionally, FIG. 11B shows a slide detent 1101 that protrudes inferiorly from the upper wall of slideway 27, and a stop peg 1102 on the superior surface of guide rail 80. As the locking pin 26 moves through the slideway 27 when a user applies force to the actuation pad 28, the detent 1101 may contact the stop peg 1102, thereby preventing the locking pin 26 from advancing to the open position. In order to overcome the slide catch mechanism, the user may apply downward force on the actuation pad 28 as the user advances the locking pin 26 through the slideway 27 toward the open position. The downward force may move the stop peg 1102 to a position that is inferior to the detent 1101, thereby allowing the stop peg 1102 to move past the detent 1101. Thus, the slide catch mechanism may prevent a child from advancing the locking pin 26 into the open position because it may not be readily apparent that the application of downward pressure on an actuation pad 28 may be required to advance the locking pin 26.

In some embodiments, and without limitation, the slide catch mechanism may include a single detent 1101 and a single stop peg 1102 on guide rail 80. In other embodiments, and without limitation, the slide catch mechanism may include bilateral detents 1101 protruding inferiorly from the upper wall of the slideway 27 and two stop pegs 1102, with one on each of the guide rails 78 and 80. In still further embodiments, and without limitation, the slide catch mechanism may have detents and stop pegs having various other positions, e.g., one or more stop pegs may be positioned on the underside of the actuation pad 28 and one or more detents may be protrude superiorly from the bottom surface of the pad channel 42, such that the actuation pad 28 must be pressed upward by the user in order to advance the locking pin 26 past the detents. Other placements are contemplated within the scope of the present invention.

The actuation pad of the present invention may be configured such that, it provides a tactile reference point for the user of the container. Such a feature may assist a user who has poor vision or who is in low light to easily operate the lid of the container. For example, and without limitation, the actuation pad may protrude from the container lid such that, a user can find the actuation pad by touch without the need to visually inspect the safety container. FIGS. 1-2 show an actuation pad 28 that extends past the edge of the lid container 14 and the container body 12 when the locking pin is in the closing position and the container lid 14 is closed over the container body 12. A user of the container can thus brush his or her thumb along the container to find the actuation pad.

Figure 12:
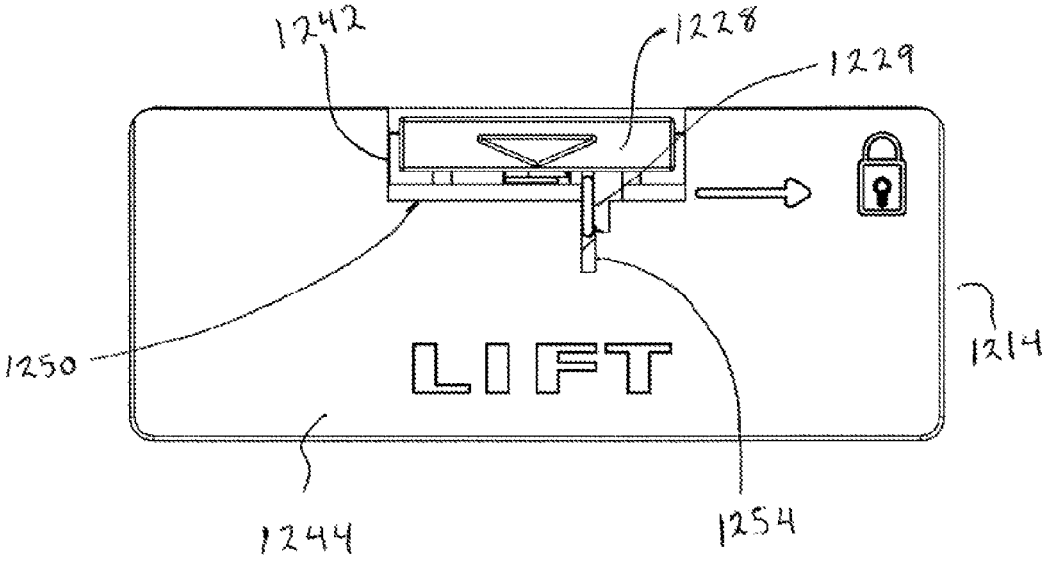
FIG. 12 is a top-down view of the top of the cover or lid of a safety container according to an embodiment of the present invention.

In other embodiments, and without limitation, the actuation pad may be recessed from an outer edge of the container lid thereby to limit access to the actuation pad, making it difficult for a child to operate the actuation pad due to the typical lack of dexterity in small children. As an example, and without limitation, FIG. 12 shows an actuation pad 1228 that is recessed into the slideway 1227 inside the edge of the lid container 1214 when the locking pin is in the closing position and the container lid 1214 is closed over the container body 1212. The recessed position of the actuation pad provides an additional childproofing feature. In still further embodiments, the proximal end of the actuation pad may be about flush with the outer edge of the container lid.

Upon using the actuation pad to open the container 10 as shown in FIG. 5, the user may release or cease applying force against the actuation pad 28. In that event, the biasing force provided by the integral S-spring urges the actuation pad 28, the dovetail end 30, and their associated integral structures into the slideway 27 back to the starting or closing position (where the tension in spring 92 is relieved) of the locking pin 26 (as shown in FIG. 9) in which the angled necks (e.g., 130) on the guide rails (e.g., 80) abut their associate guide rail necks or abutments (e.g., 121).

Figure 18:
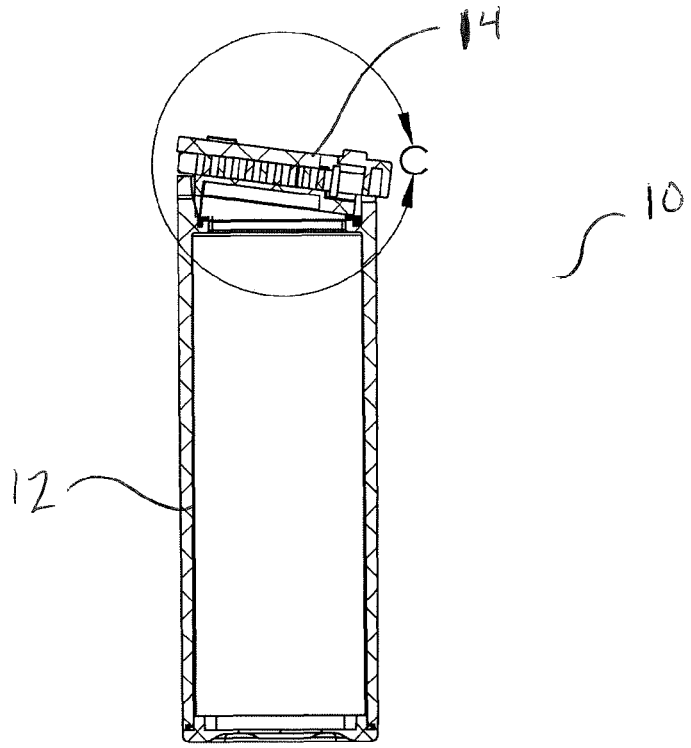
FIG. 18 is a cross-sectional view of a safety container according to an embodiment of the present invention.
Figure 19:
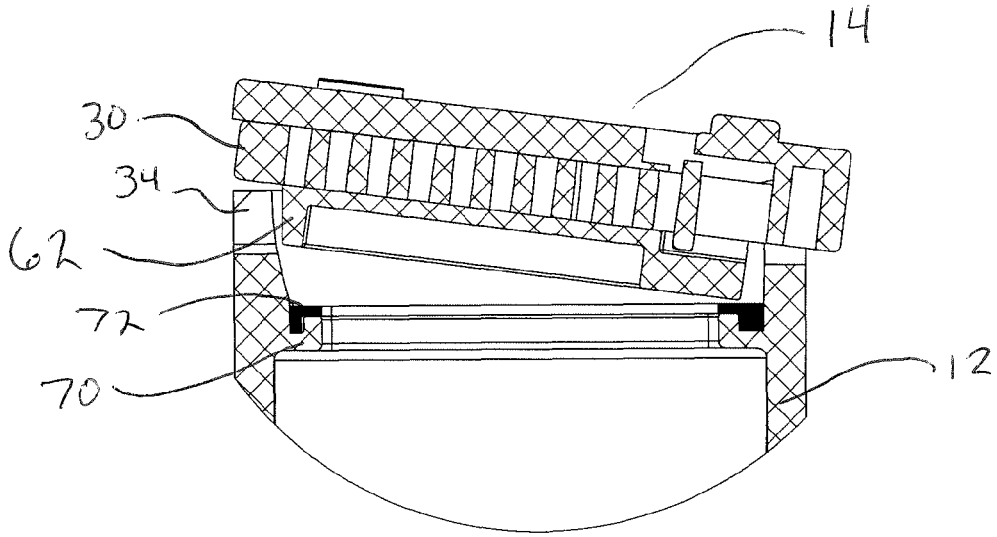
FIG. 19 is a cross-sectional view of an upper portion of a safety container according to an embodiment of the present invention showing detail view C of FIG. 18.
Figure 20:
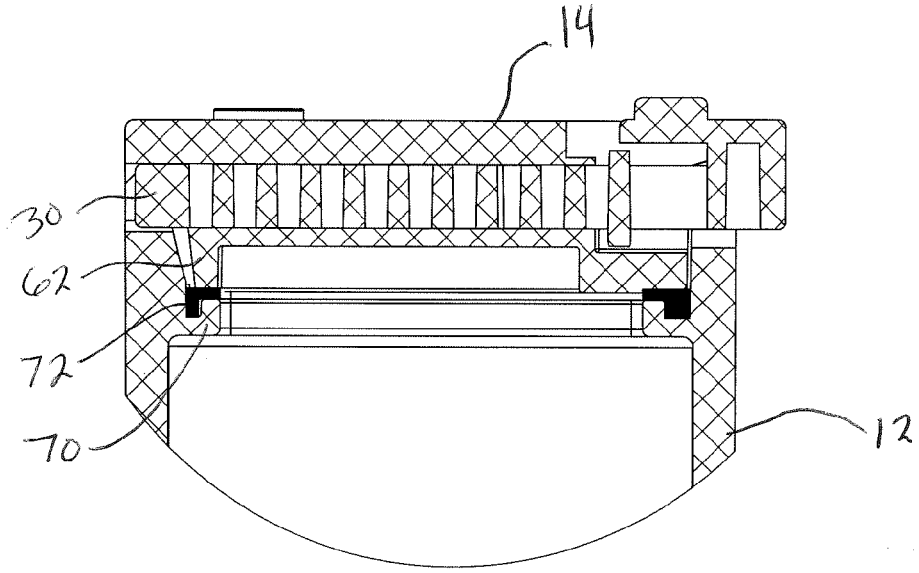
FIG. 20 is a cross-sectional view of an upper portion of a safety container according to an embodiment of the present invention showing detail view C of FIG. 18.

The lid of the container can be closed by simply pressing down on the lid thereby compressing the convex lid such that the central raised section and the lateral sections of the lid are pressed flush against the upper lip of the container. FIGS. 13-17 provide cross-sectional views of a container illustrating the interaction of the dovetail end of the lid with the locking slot of the container. FIGS. 13-17 show an embodiment that does not include an interior ridge in the container (e.g., rigid shelf 70) against which a lip ridge (e.g., lip ridge 621 on the underside of the lid may engage. FIGS. 13-17 show an embodiment in which the lip ridge of the lid may form a sealed connection with the vertical sides of the interior walls of the safety container. However, FIGS. 18-20 illustrate an embodiment in which the interior of the container includes a rigid shelf.

Figure 13:
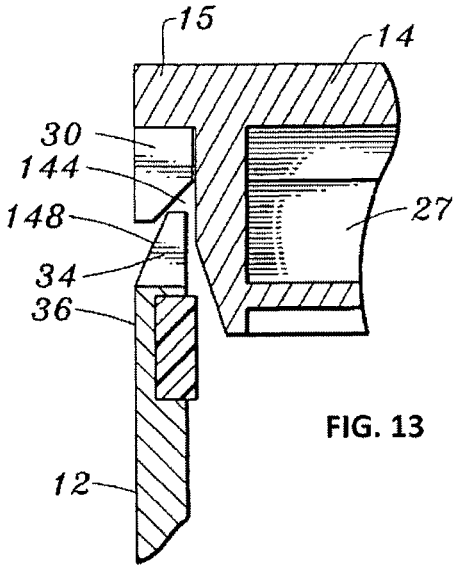
FIG. 13 is a cross-sectional view of an upper portion of a safety container according to an embodiment of the present taken along section line 9-9 of FIG. 3, showing a container lid slightly opened and a locking pin in the closing position.

Referring now to FIG. 13, when the hinged lid 14 is slightly open and the dovetail end 30 is in the home position, the dovetail end 30 is located immediately above and adjacent the locking edges (e.g., 34) on the locking slot 36. The hinge lid 14 may be easily closed by means of a single hand motion downwardly on the upper surface 15 of the hinged lid 14 as shown in FIG. 13 through FIG. 17.

Figure 14:
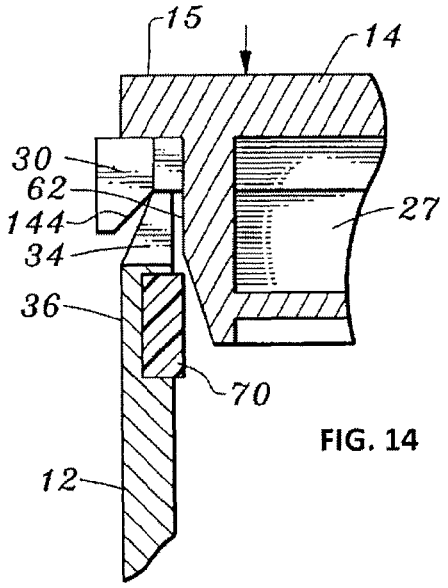
FIG. 14 is a cross-sectional view of an upper portion of a safety container according to an embodiment of the present taken along section line 9-9 of FIG. 3, showing a container lid rotated by a user downwardly into a force fit alignment with a lip of the safety container.
Figure 15:
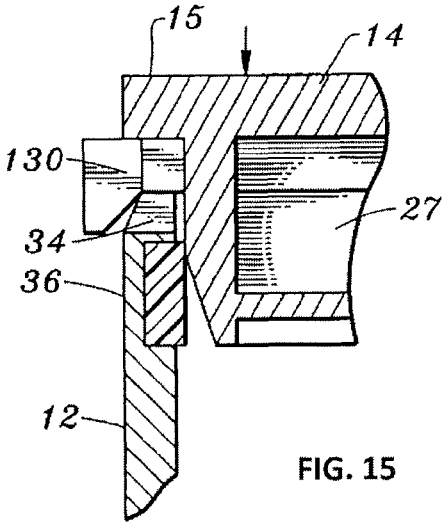
FIG. 15 is a cross-sectional view of an upper portion of a safety container according to an embodiment of the present taken along section line 9-9 of FIG. 3, showing a container lid being rotated even closer into the locked or sealed position on the container lip.

With reference to FIG. 14, as the hand (not shown) pushes downwardly on the upper surface 15 of the lid 14, the central raised section 40*a* moves inferiorly and becomes coplanar or substantially coplanar with the lateral sections 40*b* and 40*c*, and the interior sloped surface 144 of the dovetail end 30 engages the oppositely sloped periphery 148 of the adjacent locking edge (e.g., 34). With reference now to FIG. 15, the continuing downward force of the hand (not shown) on the upper surface 15 of the lid 14 forces the spring-biased dovetail end 30 to slide along mating locking edge or neck 34 and thus move the dovetail endk 30 outwardly from the slideway 27 within the lid 14.

Figure 16:
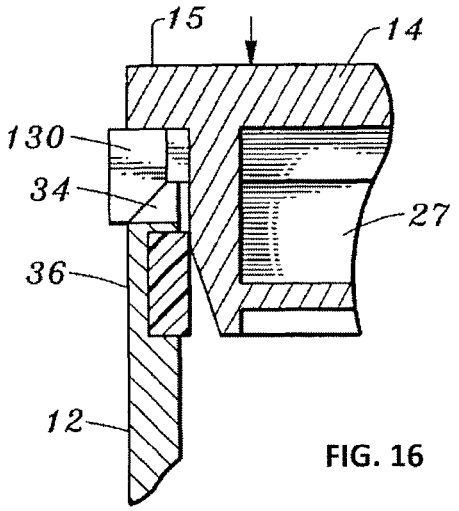
FIG. 16 is a partial cross-sectional view of the lid of FIG. 12 but with the lid being rotated into closed contact with the lip of the container, immediately prior to the locking pin returning to its spring-biased, locked position.
Figure 17:
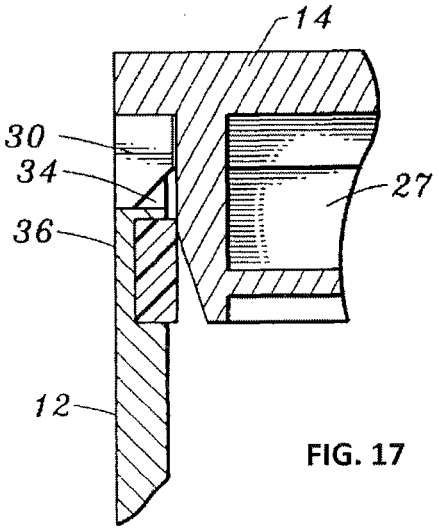
FIG. 17 is a partial cross-sectional view of the lid of FIG. 13, with the locking pin and lid in the spring biased, closed, and locked position.

With reference now to FIGS. 15, 16, and 17, the continued downward force of the hand (not shown) on the upper surface 15 (e.g., the upper surface of the central section 40*a*) of the lid 14 continues to force the spring-biased dovetail end 30 to continue to slide along the mating locking edge 34 outwardly from the slideway 27 until, as shown in FIGS. 16 and 17, the dovetail end no longer is in contact with the locking edges (e.g., 34) and is S-spring-biased to automatically slide quickly back into the slideway 27. As shown in FIGS. 17 and 1, the spring-biased dovetail end and associated structures slide back into the slideway 27 when the lid is in the closed position.

Once the dovetail end is fully engaged in the locked position within the locking slot 36 and the outer edge of the lid 14 is flush with the upper lip of the container body 12, the container body 12 may be tightly sealed and difficult for a child to open. In the closed position the stepped lip ridge 62 may be pressed outward into the internal surface of the container body 12 due to the compression the central section 40*a* of the lid 14 and the resultant outward deformation of the lid 14. The inferior edge of the stepped lip ridge 62 may be positioned flush with a compressible gasket 70 of the container body 12 to provide a tight seal between the lid 14 and the container body 12. Additionally, the stepped lip ridge 62 may have a beveled or angled outer surface 63 that may be pressed against the gasket 70, providing a compressed and sealed fit between the gasket 70 and the lip ridge 62. The fit between the gasket 70 and the lip ridge 62 may provide an air tight seal between the lid 14 and the container body 12, which may aid in the prevention of contamination of the contents of the container body 12.

FIGS. 18-20 show a similar process for an embodiment that includes a ridge 62 as described above that closes over a rigid shelf 70 within the compartment of the safety container 10. The steps of closing the lid are substantially the same as those demonstrated in FIGS. 13-17, though the structures in the embodiment shown in FIGS. 18-20 have some differences.

FIG. 18 shows a cross-section of a safety container 10 according to an embodiment of the present invention, with the upper portion, including the lid 14 circled detail section C. The detail section C is shown in FIGS. 19-20. In the embodiment shown in FIGS. 18-20 the ridge 62 on the bottom side of lid 14 closes over the rigid shelf 70 of the container. Due to the deformation of the convex lid 14 as it is held in the closed position by the locking pin 26, the ridge 62 may exert substantial pressure on the rigid shelf 70, thereby creating a tight seal (e.g., an air-tight seal). The tight seal of the lid 14 in such embodiments may help to preserve and prevent contamination of the contents of the container 10 (e.g., pharmaceuticals). In some embodiments, the rigid shelf may have a gasket 72 that is positioned on the upper surface of rigid shelf 70. The gasket 72 may be made of compressible material that is squeezed as the lid 14 is closed and the ridge 62 is brought down on top of the gasket 72. The gasket 72 may aid in creating an air tight seal of the container.

FIG. 19 shows the hinged lid 14 slightly open and the dovetail end 30 is in the starting position, the dovetail end 30 is located immediately above and adjacent the locking edges (e.g., 34) on the locking slot. The hinge lid 14 may be easily closed by means of a single hand motion downwardly on the upper surface of the hinged lid 14.

As shown in FIG. 20, once the dovetail end 30 is fully engaged in the locked position within the locking edges of the locking slot and the outer edge of the lid 14 is flush with the upper lip of the container body 12, the container body 12 may be tightly sealed. In the closed position the ridge 62 may be pressed downward onto the rigid shelf 70, which may include a gasket 72 thereover. An air-tight seal may be created between the ridge 62 and the rigid shelf 70. In some embodiments, the compression the central section 40*a* of the lid 14 may result in added pressure between the ridge 62 and the rigid shelf 70.

The present container, while relatively simple for an adult to open with a single hand, is difficult for a child to open due to the multiple childproofing features of the container. Without limiting the invention, the embodiment shown in FIG. 1, container 10 may initially be dispensed to a user with the locking tab 29 flexed in the lock-out position, as shown in FIG. 9. In order to open the container, the user must first comprehend and have the dexterity to rotate the flexed locking tab 29 into the non-flexed, open position as shown in FIG. 10. The user must then also comprehend and have the strength and dexterity to force the internally biased actuation pad 28 to slide into the slideway 27 and thus push the dovetail end 30 out of its force-fit locking and closing engagement with the opposing mating locking edges 32, 34. Only then will the hinged lid 14 open by upward rotation.

It can also be seen that the user can then, if desired, leave the locking tab 29 in its non-flexed, open position. The user can thus more easily and quickly open and close the container 10 with the single, quick closing motion described above with reference to FIGS. 13-20 and without altering the position of the locking tab 29. Alternatively, the user can utilize the locking tab 29 by re-positioning it, in the flexed, lock-out position of FIG. 9 after each closing of the container 10.

It can also be seen that, as shown in all the Figures, this substantial functionality is achieved with a single integral locking pin 26 interacting with associated structure in the molded hinge lid 14. This integral pin 26 is relatively easy and economical to manufacture and install in the container slideway 27; and the remaining components of the container 10 are also relatively easy and economical to manufacture and assemble.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is to be understood that variations and modifications of the present invention may be made without departing from the scope thereof. It is to be appreciated that the features disclosed herein may be used different combinations and permutations with each other, all falling within the scope of the present invention. It is also to be understood that the present invention is not to be limited by the specific embodiments disclosed herein, but only in accordance with the appended claims when read in light of the foregoing specification.

What is claimed is:

1. A safety container, comprising:

a. a container body having a locking slot in an upper rim of said body;

b. a container lid having a convex structure, wherein said container lid must be compressed and deformed into said upper rim of said container body in order to conform to said upper rim;

c. a locking pin slidably mounted within a pin channel in said container lid and adapted to move between: (i) a closed position lockingly engaging the locking slot; and (ii) an opening position in which the locking pin is disengaged from the locking slot;

d. a locking tab slot within the container lid; and e. a locking tab rotatably mounted in the container lid moveable to rotate between: (i) an unlocked position in which the locking tab may penetrate the locking tab slot and allow relative movement between the container lid and the locking pin, and (ii) a lock-out position in which the locking tab may not penetrate the locking tab slot thereby preventing relative movement between the container lid and locking pin.

2. The safety container of claim 1, wherein the locking pin includes an actuation pad that can be pushed to advance the locking pin in the pin channel.

3. The safety container of claim 2, wherein said container lid has an abutment for blocking the actuation pad from advancement past said abutment, and wherein the locking tab slot penetrates the pin abutment.

4. The safety container of claim 2, wherein the locking pin is made of a resilient material and has a spring integrally formed in the locking pin, the spring having a proximal section adapted to engage at one end with an engagement point on said container lid such that the spring can be stretched from the engagement point as the locking pin advances in the pin channel, wherein the spring and the engagement point cooperatively bias the locking pin to slide into the closing position.

5. The safety container of claim 2, wherein said actuation pad protrudes from said container lid to provide a tactile reference point allowing a user to find said actuation pad by touch without the need to visually inspect the safety container.

6. The safety container of claim 2, wherein said actuation pad is recessed from an outer edge of said container lid thereby to limit access to said actuation pad.

7. The safety container of claim 1, wherein the container lid comprises a central portion, a first lateral portion, and a second lateral portion, wherein said central portion, said first lateral portion, and said second lateral portion are integrally formed, and said first portion is attached to said central portion at a first oblique angle, and said second portion is attached to said central portion at a second oblique angle, wherein said first oblique angle and said second oblique angle result in said convex structure of said container lid.

8. The safety container of claim 7, wherein the convex structure of said container lid requires that the container lid be compressed and substantially flattened to close and seal the lid over the container body.

9. The safety container of claim 8, wherein said central portion, said first lateral portion, and said second lateral portion are substantially coplanar and said container lid is positioned flush against said upper rim of said container when said container lid is closed.

10. The safety container of claim 8, wherein said container lid stores potential energy when closed and positioned flush against said upper rim of said container, said container lid pops open when said locking pin is moved into said opening position as said potential energy causes said deformed container lid to resile to its convex structure.

11. The safety container of claim 1, further comprising an interior ridge that is parallel to said upper rim of said container body, and positioned to abut a sealing lip on a bottom side of said container lid when said container lid is closed against said upper rim of said body.

12. The safety container of claim 11, wherein said contact between said interior ridge and said sealing lip creates an airtight seal.

13. The safety container of claim 1, wherein the container lid is rotatably mounted on the container body on an attached side of the container lid opposite a locking side of the container lid, wherein the locking pin is lockingly engages the locking slot at the locking side of the container lid.

14. The safety container of claim 1, wherein the locking pin is made of a resilient material and includes a spring integrally formed in the locking pin and having a proximal end engaging the container lid, whereby the locking pin is biased to slide into the locked position.

15. The safety container of claim 2, further comprising a detent in said pin channel for catching a peg on said locking pin when said locking pin is advanced through said pin channel.

16. The safety container of claim 15, wherein said actuation pad must be pressed down as it is advanced through said pin channel in order to avoid said peg from catching on said detent.

17. A safety container, comprising:

a. a container body and an upper rim portion surrounding a passage in the body, said upper rim having a locking slot formed therein;

b. a container lid having a convex structure and a sealing lip on a bottom side thereof, wherein said container lid must be compressed and deformed into said upper rim of said container body in order to conform to said upper rim and to close said safety container; and c. a locking pin slidably mounted within a pin channel in said container lid and adapted to lockingly engage said locking slot in said upper rim when said container lid is compressed into said upper rim.

18. The safety container of claim 17, further comprising an interior ridge in said container body at an upper end of said passage, said interior ridge positioned to abut said sealing lip when said container lid compressed into said upper rim and said safety container is closed.

19. The safety container of claim 18, wherein said contact between said interior ridge and said sealing lip creates an airtight seal.

20. The safety container of claim 17, wherein said locking pin is adapted to move between: (i) a closing position in which said locking pin lockingly engages said locking slot; and (ii) an opening position in which said locking pin is disengaged from the locking slot.

21. The safety container of claim 20, wherein the locking pin includes an actuation pad that can be pushed to advance the locking pin in the pin channel.

22. The safety container of claim 21, wherein said container lid has an abutment for blocking the actuation pad from advancement past said abutment.

23. The safety container of claim 22, wherein the locking pin is made of a resilient material and has a spring integrally formed in the locking pin, the spring having a proximal section adapted to engage at one end with an engagement structure of said container lid such that the spring can be stretched from said engagement structure as the locking pin advances in the pin channel, wherein the spring and said engagement structure cooperatively bias the locking pin to slide into the closing position.

24. The safety container of claim 21, wherein said actuation pad protrudes from said container lid to provide a tactile reference point allowing a user to find said actuation pad by touch without the need to visually inspect the safety container.

25. The safety container of claim 21, wherein said actuation pad is recessed from an outer edge of said container lid thereby to limit access to said actuation pad.

26. The safety container of claim 20, further comprising a locking tab in the container lid for preventing said locking pin from being advanced through said pin channel and preventing said safety container from being opened.

27. The safety container of claim 26 wherein said locking tab is moveable between: (i) an unlocked position allowing relative movement between the locking pin and the container lid; and (ii) a lock-out position in which the locking tab is engaged with a locking notch in said container lid, thereby preventing relative movement between the locking pin and the container lid.

28. The safety container of claim 17, wherein the container lid comprises a central portion, a first lateral portion, and a second lateral portion, wherein said central portion, said first lateral portion, and said second lateral portion are integrally formed, and said first portion is attached to said central portion at a first oblique angle, and said second portion is attached to said central portion at a second oblique angle, wherein said first oblique angle and said second oblique angle result in said convex structure of said container lid.

29. The safety container of claim 28, wherein the convex structure of said container lid requires that the container lid be compressed and substantially flattened such that said central portion, said first lateral portion, and said second lateral portion are substantially coplanar and said container lid is positioned flush against said upper rim of said container.

30. The safety container of claim 29, wherein said container lid stores potential energy when positioned flush against said upper rim of said container, said container lid pops open when said locking pin is disengaged from said locking slot as said potential energy causes said deformed container lid to resile to its convex structure.

31. The safety container of claim 20, wherein said container lid pops open when said locking pin is moved into said opening position.

32. The safety container of claim 21, further comprising a detent in said pin channel for catching a peg on said locking pin when said locking pin is advanced through said pin channel.

33. The safety container of claim 32, wherein said actuation pad must be pressed down as it is advanced through said pin channel in order to avoid said peg from catching on said detent.

34. A safety container, comprising:

a. a container body and an upper rim surrounding a passage in the body;

b. a container lid having at least two portions attached to each other at an oblique angle, wherein said oblique angle results in said container lid having a convex structure; and c. a locking pin mounted in said container lid and adapted to move between:

(i) a closing position lockingly engaging a locking slot in said upper rim; and (ii) an opening position disengaging said locking pin from locking engagement with said locking slot, wherein said container lid is operable to be compressed and deformed such that said at least two portions are substantially coplanar and said container lid rests substantially flush against said upper rim.

35. The safety container of claim 34, wherein said locking pin is positioned to engage said locking slot when said container lid is positioned flush against said upper rim of said container, and said container lid pops open when said locking pin is moved from said closing position to said opening position allowing said deformed container lid to resile to its convex structure.

36. The safety container of claim 34, further comprising an interior ridge in said container body at an upper end of said passage, said interior ridge positioned to abut a sealing lip on an bottom side of said container lid when said container lid is compressed into said upper rim and said safety container is closed.

37. The safety container of claim 36, wherein said contact between said interior ridge and said sealing lip creates an airtight seal.

38. The safety container of claim 34, wherein the locking pin includes an actuation pad that can be pushed to advance the locking pin in a pin channel in said container lid.

39. The safety container of claim 38, wherein said container lid has an abutment for blocking the actuation pad from advancement past said abutment.

40. The safety container of claim 38, wherein the locking pin is made of a resilient material and has a spring integrally formed in the locking pin, the spring having a proximal section adapted to engage at one end with an engagement structure of said container lid such that the spring can be stretched from said engagement structure as the locking pin advances in the pin channel, whereby the spring and said engagement structure cooperatively bias the locking pin to slide into the closing position.

41. The safety container of claim 38, wherein said actuation pad protrudes from said container lid to provide a tactile reference point allowing a user to find said actuation pad by touch without the need to visually inspect the safety container.

42. The safety container of claim 38, wherein said actuation pad is recessed from an outer edge of said container lid to thereby limit access to said actuation pad.

43. The safety container of claim 34, wherein said container lid pops open when said locking pin is moved into said opening position.

44. The safety container of claim 38, further comprising a detent in a pin channel in said container lid, said detent being operable to catch a peg on said locking pin when said locking pin is advanced through said pin channel.

45. The safety container of claim 44, wherein said actuation pad must be pressed down as it is advanced through said pin channel in order to avoid said peg from catching on said detent.

* * * * *